US010843487B2

(12) United States Patent
Izawa et al.

(10) Patent No.: US 10,843,487 B2
(45) Date of Patent: Nov. 24, 2020

(54) INK DRYING APPARATUS FOR DRYING INK BY HEAT AFTER PRINTING

(71) Applicant: MIYAKOSHI PRINTING MACHINERY CO., LTD., Narashino (JP)

(72) Inventors: Hideo Izawa, Narashino (JP); Koichi Oyama, Yokote (JP); Kazushige Sato, Yokote (JP); Hidetoshi Kon, Yokote (JP); Yuuichi Yamazaki, Narashino (JP); Ayumu Sasaki, Yokote (JP)

(73) Assignee: MIYAKOSHI PRINTING MACHINERY CO., LTD., Narashino (JP)

( * ) Notice: Subject to any disclaimer, the term of this patent is extended or adjusted under 35 U.S.C. 154(b) by 0 days.

(21) Appl. No.: 16/424,886

(22) Filed: May 29, 2019

(65) Prior Publication Data

US 2020/0031142 A1 Jan. 30, 2020

(30) Foreign Application Priority Data

Jul. 25, 2018 (JP) ..... 2018-139658

(51) Int. Cl.
*B41J 11/00* (2006.01)

(52) U.S. Cl.
CPC ..... *B41J 11/002* (2013.01); *B41J 11/0015* (2013.01)

(58) Field of Classification Search
CPC .... B41J 11/002; B41J 11/0015; B41J 29/377; F26B 3/283
See application file for complete search history.

(56) References Cited

U.S. PATENT DOCUMENTS

| | | | | |
|---|---|---|---|---|
| 772,695 | A | 10/1904 | Crowell | |
| 9,975,354 | B1 * | 5/2018 | Boland | B41J 11/002 |
| 2009/0297245 | A1 | 12/2009 | Godden et al. | |
| 2015/0174924 | A1 | 6/2015 | Fuchioka et al. | |
| 2017/0173973 | A1 | 6/2017 | Tsutsui et al. | |

FOREIGN PATENT DOCUMENTS

| | | | |
|---|---|---|---|
| JP | H04-122035 | U | 10/1992 |
| JP | 2001-141364 | A | 5/2001 |
| JP | 6142942 | B2 | 6/2017 |
| JP | 2018-065262 | A | 4/2018 |

OTHER PUBLICATIONS

Dec. 2, 2019 extended Search Report issued in European Patent Application No. 19186350.5.

* cited by examiner

*Primary Examiner* — Henok D Legesse
(74) *Attorney, Agent, or Firm* — Oliff PLC

(57) ABSTRACT

A compact ink drying apparatus is capable of drying ink ejected to a resin substrate. The ink drying apparatus has a hot air dryer, a hot air supplying part, and an exhausting part. The hot air dryer has a drying furnace, a substrate conveying path formed as a spirally shaped path in the drying furnace, and substrate drying ducts blowing hot air to a surface of a resin substrate on which ink is ejected conveyed along the substrate conveying path to heat ink and exhausting water vapor generated by heating of ink. The hot air supplying part is outside the drying furnace and supplies hot air into the substrate drying ducts, and the exhausting part is outside the drying furnace and exhausts air in the drying furnace through the substrate drying ducts.

9 Claims, 16 Drawing Sheets

INK DRYING APPARATUS FOR DRYING INK BY HEAT AFTER PRINTING

TECHNICAL FIELD

The present invention is related to an ink drying apparatus for drying ink by heat after printing, in an inkjet printing machine for performing printing by ejecting aqueous ink on a surface of a resin substrate using an inkjet head.

BACKGROUND ART

As ink drying apparatuses for drying ejected ink by heat, after aqueous ink has been ejected to a surface of the substrate for printing, there have been known a first ink drying apparatus disclosed in JP unexamined patent publication No. 2001-141364, a second ink drying apparatus disclosed in patent document JP patent publication No. 6142942, a third ink drying apparatus disclosed in JP unexamined utility model publication No. H4-122035, and a fourth ink drying apparatus disclosed in JP unexamined patent publication No. 2018-065262.

The first ink drying apparatus is provided with a drying drum with a heater, a device for blowing hot air to a surface of the drying drum, and a device for exhausting hot air blown to the surface of the drying drum, and is configured such that ink ejected on a surface of a substrate is dried by hot air blown to the surface of the substrate and heat of the heater of the drying drum while the substrate is wound around and conveyed on the surface of the drying drum.

The second ink drying apparatus is configured such that a spiral path to convey a substrate (web) is formed by a plurality of rollers positioned in a spiral pattern and ink ejected on a surface of the substrate is dried by heat of the rollers while the substrate (web) is conveyed along the path.

The third ink drying apparatus is provided with a winding reel, a plurality of rolls and a plurality of heaters on a box of a curing oven, and is configured such that ink ejected on a surface of a substrate (printed ink) is dried (hardened) by heat of the heaters while the substrate (film sheet) having been passed through the box is spirally conveyed by the plurality of rolls and wound up by the winding reel.

The fourth ink drying apparatus uses an infrared dryer.

SUMMARY OF THE INVENTION

Problems to be Solved by the Invention

A printing machine has been known that performs printing by ejecting aqueous ink on a surface of a resin substrate such as a film sheet using inkjet heads.

Inventors of the present invention have carried out drying of ink ejected on a surface of the substrate by using the first, second, third, fourth ink drying apparatuses disclosed in JP unexamined patent publication No. 2001-141364, JP patent publication No. 6142942, JP unexamined utility model publication No. H4-122035 and JP unexamined patent publication No. 2018-065262 respectively in such printing machine, but no pleasing result could be obtained.

It was found that causes lay in differences in the permeability of ink into the substrate and in temperature applicable to the substrate between a paper substrate and a resin substrate.

In other words, the permeability of ink into the resin substrate is smaller than that into the paper substrate, which means that an amount of ink to be dried on the resin substrate is larger, and higher drying capacity is required for the drying apparatus. Since the resin substrate would be damaged at high temperature, temperature applicable to the resin substrate is lower than that applicable to the paper substrate.

From these, it is necessary to dry ink ejected on a surface of the resin substrate for a long time at low temperature at which damage could not be caused to the substrate.

As the first ink drying apparatus conveys the substrate by winding it around an outer periphery of the drying drum, a conveying distance (drying distance) of the substrate for drying ink depends on an outer diameter of the outer periphery of the drying drum, and as the outer diameter of the outer periphery of the drying drum has a limitation from a standpoint of an installation space, the conveying distance of the substrate for drying ink may not be increased, and a drying time proportional to the conveying distance as well may not be increased.

Therefore, the first ink drying apparatus is not suitable for drying ink ejected on the surface of the resin substrate.

Furthermore, the first ink drying apparatus has a purpose to dry ink ejected on the paper substrate and therefore can dry ink ejected on the paper substrate.

As the second ink drying apparatus conveys the substrate along the spiral path and dries ink by heat of the rollers, a conveying distance (drying distance) of the substrate for drying ink can be increased, drying time can be extended, moreover the path for conveying the substrate has a spiral shape. As a result, the apparatus can be made compact.

However, in the second ink drying apparatus, as ink is dried by using heat of a plurality of rollers previously heated, it is not suitable for drying ink ejected on a surface of the resin substrate.

Moreover, the substrate is spirally conveyed, water vapor generated by heating of ink may be collected between the substrates, which may cause prevention of ink from drying.

In the third ink drying apparatus, as the substrate is spirally conveyed in the box, the conveying distance (drying distance) of substrate for drying ink can be increased, drying time can be extended, and moreover the path for conveying the substrate has a spiral shape, the apparatus can be made compact.

However, in the third ink drying apparatus, water vapor generated by heating ink may be collected in the box which may cause prevention of ink from drying.

In the fourth ink drying apparatus, an effect of infrared ray is given much more to ink than to a resin substrate when using the infrared dryer alone, but the effect may be varied depending on colors of ink. For example, as there is a big difference in an optical absorption between black (K) and cyan (C), it is necessary to accommodate an output of irradiation of infrared ray to a color of relatively low absorption to dry them all at once. But, by irradiating infrared ray in this way, ink of relatively high absorption would be overheated, then it is difficult to uniformly dry ink of all colors within a short drying time in a short conveying path.

In other words, in the infrared dryer in which light (infrared ray) is irradiated to the substrate and ink ejected on a surface of the substrate, if the substrate is transparent, an effect of infrared ray energy to colored ink non-transmissible to light may be enhanced.

But there are differences in the effect among colors, for example, four primary colors of black(K), cyan(C), magenta (M), yellow(Y) of colored ink, accordingly, when multi-colored article such as aprinted matter is mounted on the substrate, it is necessary to set an output of the infrared ray to a temperature at which ink of color the least subject to the effect of the infrared ray energy (i.e. the least susceptibility to temperature rise) can be dried within a passing time of the substrate through an inside a drying furnace.

Then, black, etc. subject to the effect of the infrared ray would be overheated and damaged together with the substrate. Accordingly, the infrared dryer alone cannot be suitable for drying ink. Moreover, when the substrate is colored, it is necessary to consider the effect of the infrared ray not only due to the color of ink but also due to the color of substrate on the substrate itself. Furthermore, even if the substrate is transparent, temperature of the substrate is not always unincreased, after temperature inside a furnace has been increased by the infrared ray, the substrate would be damaged in a hot environment within the furnace.

From these, the infrared dryer alone cannot be suitable for drying ink ejected on the surface of the resin substrate.

The present invention is made to solve the above-mentioned problems and its object is to provide an ink drying apparatus capable of drying aqueous ink ejected on a surface of a resin substrate by an inkjet head, exhausting water vapor generated by heating ink to an outside the apparatus, and attaining miniaturization of the apparatus.

Means for solving the problems

An ink drying apparatus of the present invention comprises a hot air dryer, a hot air supplying part, and an exhausting part;

wherein the hot air dryer is provided with a drying furnace, a substrate conveying path formed as a spirally shaped path provided in the drying furnace, and a plurality of substrate drying ducts blowing hot air to a surface of a substrate on which ink is ejected conveyed along the substrate conveying path to heat ink and exhausting water vapor generated by heating of ink, the hot air supplying part is provided at an outside the drying furnace and configured to supply hot air into the substrate drying duct, and the exhausting part is provided at the outside the drying furnace and configured to exhaust air in the drying furnace through the substrate drying ducts.

In the ink drying apparatus of the present invention, the ink drying apparatus can be configured such that the hot air supplying part has a hot air supplying pipe to which hot air is supplied and communicated with a hot air blowout space of each of the plurality of substrate drying ducts, and the exhausting part has an exhausting pipe from which air is sucked and communicated with an air suction space of each of the plurality of substrate drying ducts.

Moreover, hot air can be uniformly supplied to the plurality of substrate drying ducts and air in the drying furnace can be uniformly sucked from the plurality of substrate drying ducts and exhausted.

In the ink drying apparatus of the present invention, the ink drying apparatus can be configured such that at least one of the hot air supplying pipe and the exhausting pipe has a spiral shape.

Moreover, at least one of the hot air supplying pipe and the exhausting pipe can easily connected to the substrate drying duct.

In the ink drying apparatus of the present invention, the ink drying apparatus can be configured such that at least one of the hot air supplying pipe and the exhausting pipe is opened at one side in a longitudinal direction and sealed at the other side in a longitudinal direction, and one side in the longitudinal direction is communicated with the other side in the longitudinal direction.

Moreover, at least one of functions can be achieved, that is, the function to more uniformly supply hot air into the plurality of substrate drying ducts, and the function to more uniformly suck air in the drying furnace from the plurality of substrate drying ducts and to exhaust it.

In the ink drying apparatus of the present invention, the ink drying apparatus can be configured to have at least one of heat retaining ducts in drying furnace for supplying hot air into the drying furnace, and at least one of exhausting ducts in drying furnace for exhausting air in the drying furnace to the outside the drying furnace.

Moreover, high temperature in the drying furnace can assist in drying of ink and water vapor in the drying furnace can be exhausted without fail.

In the ink drying apparatus of the present invention, the ink drying apparatus can be configured such that the substrate drying duct is provided with outer ducts having a hot air blowout space for blowing hot air to the surface of the substrate and an exhaust space for sucking air in a surrounding area on which the hot air is blown out and inner ducts provided in the hot air blowout space and in the exhaust space respectively, an inside an inner duct provided in the hot air blowout space is opened to the hot air blowout space, and is communicated with the hot air supplying part, and an inside the inner duct provided in the exhaust space is opened to the exhaust space and is communicated with the exhausting part.

Moreover, the substrate drying duct can be made compact. In addition, hot air can be uniformly blown to the surface of the substrate, and high temperature air containing water vapor can be uniformly sucked from a proximity of the surface of the substrate and exhausted.

In the ink drying apparatus of the present invention, the ink drying apparatus can be configured such that the inner duct provided in the hot air blowout space has a plurality of supplying holes, an opening area of the supplying hole is decreased as separating from a part communicated with the hot air supplying part, and the inner duct provided in the exhaust space has a plurality of sucking holes, an opening area of the sucking hole is increased as separating from a part communicated with the exhausting part.

Moreover, blowing of hot air becomes more uniform, and air containing water vapor can be more uniformly sucked and exhausted.

In the ink drying apparatus of the present invention, the ink drying apparatus can be configured such that an infrared dryer for heating the substrate is provided on an upstream side of the drying furnace in a substrate conveying direction.

Moreover, ink ejected on the substrate can efficiently be dried.

In the ink drying apparatus of the present invention, the ink drying apparatus can be configured such that a heat exchanger raising temperature of air flowing through the hot air supplying part with heat of air flowing into the exhausting part, air being at high temperature in the drying furnace.

Moreover, ink can efficiently be dried.

Advantageous Effects of the Invention

According to the ink drying apparatus of the present invention, aqueous ink ejected on the surface of the resin substrate by the inkjet head can be dried, and water vapor generated by heating ink can be exhausted to the outside the apparatus, moreover the drying apparatus can be made compact.

PREFERRED EMBODIMENTS OF THE INVENTION

Figure 1:
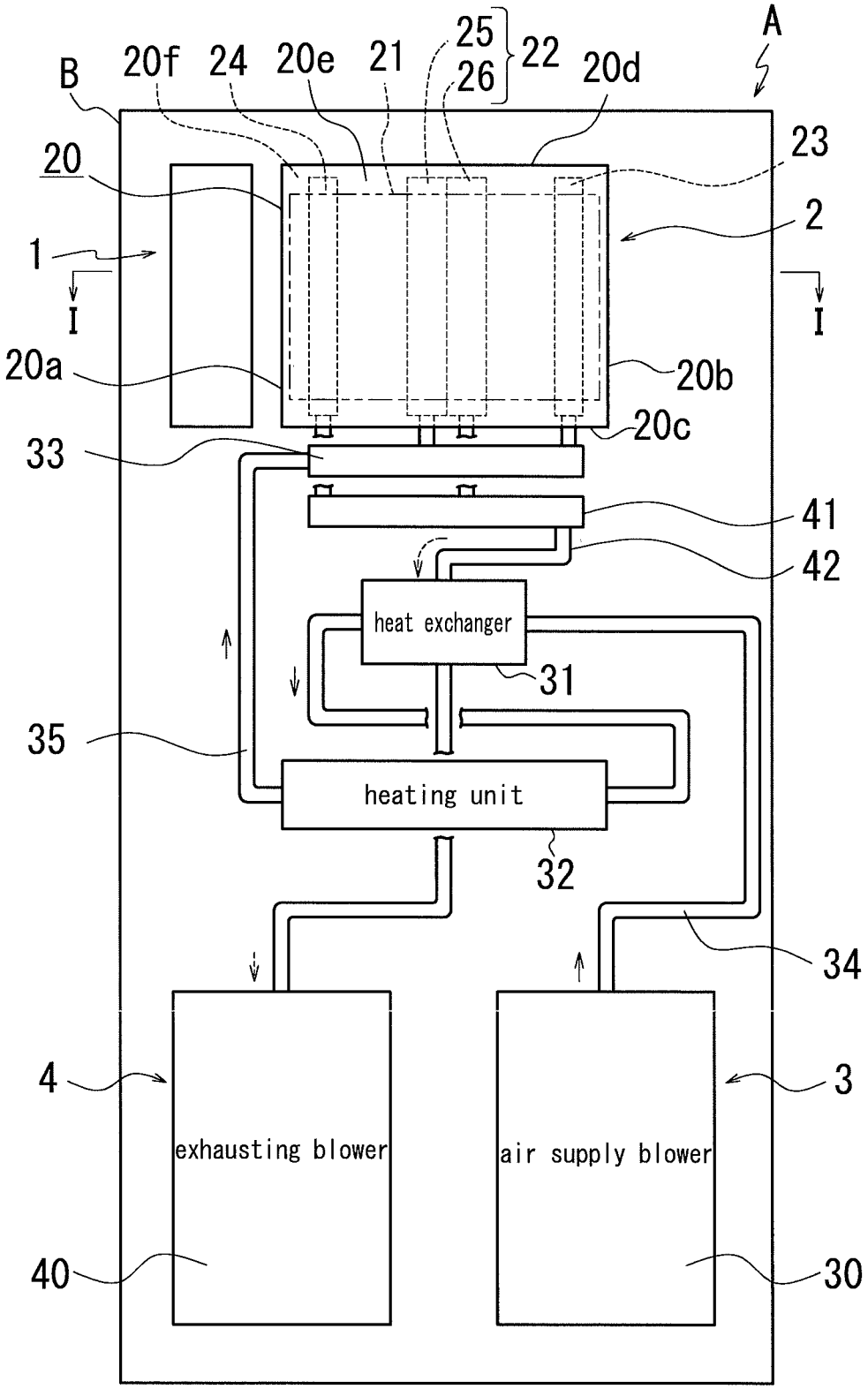
FIG. 1 is a plain view schematically showing the whole of an ink drying apparatus of the present invention.

The whole structure of an ink drying apparatus of the present invention will be described with reference to FIG. 1. FIG. 1 is a plain view schematically showing the whole of the ink drying apparatus of the present invention.

Furthermore, FIG. 1 shows the ink drying apparatus in a schematic way to facilitate understanding of the ink drying apparatus. A shape, an arrangement, a size and so on of each member can be different from those of particular structures shown in Figs following FIG. 2.

As shown in FIG. 1, an ink drying apparatus A of the present invention has a base B, an infrared dryer 1, a hot air dryer 2, a hot air supplying part 3 and an exhausting part 4 attached to the base B respectively.

A printer of a printing machine (not shown) is provided on an upstream side of the infrared dryer 1 in a substrate conveying direction. The printer performs printing by ejecting aqueous ink on one surface of a resin substrate using an inkjet head.

While the resin substrate(merely called as substrate hereinafter), on the surface of which ink is ejected, is passed through the infrared dryer 1 and then is passed through the hot air dryer 2, ink ejected on the surface of the substrate is dried.

The infrared dryer 1 is aimed to perform an initial drying of ink ejected on the surface of the substrate and performs the initial drying of ink by heating of ink with radiation of light (infrared ray). In this embodiment, a carbon heater is used as the infrared dryer 1. An infrared heater such as the carbon heater and the like can be quickly started, so that an object to be heated can be quickly heated. Whereas, according to a hot air from the hot air dryer 2 described later alone, it takes time to heat the substrate and ink on the surface of the substrate, therefore, the infrared dryer 1 is used for obtaining initial drying effect and preheating effect.

By providing the infrared dryer 1, temperature of the substrate and ink ejected on the surface of the substrate can be quickly risen in a short time. By the way, when the infrared ray is absorbed as heat, a rate of heat absorption is varied due to a background color of the substrate as for the substrate and a color material of ink as for ink.

For example, when the ground color of the substrate is transparent, an amount of heat absorbed by the substrate is decreased. As for ink, it has been known that there is a big difference in the amount of heat absorbed between black (K) and cyan (C) of the color material. Moreover, it has also been known that the rate of heat absorption of an object to be heated may be varied due to various wave lengths of the infrared ray depending on the kind of infrared heaters.

When the carbon heater used in this embodiment is the infrared heater, the wavelength of the infrared ray is relatively long, therefore, differences in temperature rises of the objects to be heated due to a differences in the rate of heat absorption of the color of ink can be reduced, as compared with the infrared heater with a short wavelength.

From this, in the infrared dryer 1, it is supposed that ink would not be uniformly dried or that damage to the substrate would be caused when ink ejected on the surface of the substrate is multi-colored or the substrate has a colored background. Accordingly, the infrared dryer 1 is set to operate at a low output such that ink of the lowest rate of heat absorption would be dried without being mixed with adjacent color(s) and that ink of the highest rate of heat absorption together with the substrate would be dried without damaging due to overheat.

For example, temperature of ink after having passed through the infrared dryer 1 can be risen up to 40° C.-80° C., thereafter since ink is further dried by the hot air dryer 2, ink can be uniformly and efficiently dried.

In other words, in the hot air dryer 2, since the substrate and ink ejected on the surface of the substrate are exposed to hot air, which results in temperature rise of the substrate and ink. Although damage to the substrate would be increased at high temperature, by applying hot air at low temperature for a long time, ink can be dried while restraining the damage to the substrate.

Accordingly, ink on the substrate can be uniformly and efficiently dried by performing drying at low temperature for a long time in the hot air dryer 2, after the initial drying of ink at low temperature has been performed by the infrared dryer 1 to an extent that a color mixing of ink on the substrate could not be occurred.

In addition, by performing the initial drying of ink, an initial state of ejected ink can be preserved without disturbance such as crush or spread of ink due to subsequent conveyance of the substrate and so on.

The hot air dryer 2 has a drying furnace 20. The drying furnace 20 is formed in a box shape from a first side wall 20*a* on the infrared dryer 1 side, a second side wall 20*b* facing to the first side wall 20*a* on the opposite side of the infrared dryer 1, a third side wall 20*c*, a fourth side wall 20*d* facing to the third side wall 20*c*, an upper wall 20*e* and a lower wall 20*f*.

The fourth side wall 20*d* is an openable door, the door is to be opened to allow for performing a maintenance work in the drying furnace 20 upon stopping of drying work.

There are provided in the drying furnace 20, a substrate conveying path 21, a substrate drying duct 22, a heat retaining duct 23 in drying furnace and an exhausting duct 24 in drying furnace.

The substrate conveying path 21 has a spiral shape, capable of making the drying furnace 20 compact while providing an elongated substrate conveying path as described later.

The substrate drying duct 22 performs an operation for blowing hot air to the surface of the substrate conveyed along the substrate conveying path 21 and an operation for exhausting high temperature air surrounding a part of the substrate to which hot air is blown and water vapor generated by heating ink (hereinafter called as high temperature air containing water vapor) to the outside the drying furnace 20.

The substrate drying duct 22 is provided with a hot air blowing duct 25 for blowing hot air and an exhausting duct 26 for exhausting high temperature air containing water vapor. The hot air blowing duct 25 is located on the upstream side in the substrate conveying direction, and the exhausting duct 26 is located on a downstream side in the substrate conveying direction.

The heat retaining duct 23 in drying furnace is aimed to supply hot air into the drying furnace 20.

The exhausting duct 24 in drying furnace is aimed to exhaust air in the drying furnace 20 to the outside.

The hot air supplying part 3 supplies hot air to the substrate drying duct 22 (the hot air blowing duct 25) and the heat retaining duct 23 in drying furnace.

The exhausting part 4 exhausts air in the drying furnace 20 from the substrate drying duct 22 (the exhausting duct 26) and the exhausting duct 24 in drying furnace.

The hot air supplying part 3 has an air supplying blower 30, a heat exchanger 31, a heating unit 32 and a spiral hot air supplying pipe 33.

The exhausting part 4 has an exhausting blower 40, a spiral exhausting pipe 41 and the heat exchanger 31.

Air supplied from the air supplying blower 30 is sent to the heating unit 32 via the heat exchanger 31 through an air supplying piping 34 and is heated to hot air by the heating unit 32.

Hot air is sent to the spiral hot air supplying pipe 33 through a hot air supplying pipe 35 and is supplied from the spiral hot air supplying pipe 33 to the substrate drying duct 22 (the hot air blowing duct 25) and the heat retaining duct 23 in drying furnace.

Hot air supplied to the hot air blowing duct 25 is blown to the surface of the substrate to dry ink.

Hot air supplied to the heat retaining duct 23 in drying furnace flows into the drying furnace 20 and heats an inside the drying furnace 20 and retains its heat.

In other words, a piping for supplying hot air which supplies hot air to the hot air blowing duct 25 and the heat retaining duct 23 in drying furnace is constituted by the hot air supplying pipe 35 and the spiral hot air supplying pipe 33. Furthermore, the spiral hot air supplying pipe 33 can be a linear pipe. Moreover, hot air may be sent to the hot air blowing duct 25 and the heat retaining duct 23 in drying furnace by the hot air supplying pipe 35 without providing the spiral hot air supplying pipe 33. The hot air supplying pipe 35 is the piping for supplying hot air in this case.

Air in the spiral exhausting pipe 41 is sucked by driving the exhausting blower 40 through an exhausting pipe 42.

By sucking air in the spiral exhausting pipe 41, high temperature air containing water vapor is flown into the spiral exhausting pipe 41 via the substrate drying duct 22 (the exhausting duct 26). High temperature air containing water vapor flown into the spiral exhausting pipe 41 is exhausted to an exhausting equipment at the outside the ink drying apparatus A by the exhausting blower 40 via the heat exchanger 31 through the exhausting pipe 42.

High temperature air retaining the heat in the drying furnace 20 and water vapor unexhausted through the substrate drying duct 22 (the exhausting duct 26) are flown into the spiral exhausting pipe 41 via the exhausting duct 24 in drying furnace. Air and water vapor flown into the spiral exhausting pipe 41 are exhausted to the exhausting equipment at the outside the ink drying apparatus A by the exhausting blower 40 via the heat exchanger 31 through the exhausting pipe 42.

In other words, an exhaust piping which exhausts air and water vapor in the drying furnace 20 is constituted by the spiral exhausting pipe 41 and the exhausting pipe 42. Furthermore, the spiral exhausting pipe 41 can be a linear pipe. Moreover, air and water vapor may be exhausted by the exhausting pipe 42 without providing the spiral exhausting pipe 41. The exhausting pipe 42 is the exhaust piping in this case.

In this way, as water vapor generated by heating ink is exhausted to the outside the drying furnace 20, ink would not be suppressed from drying by water vapor.

In the heat exchanger 31, high temperature air in the drying furnace 20 comes into contact with outside air at low temperature (fresh air) supplied from the air supplying blower 30 and delivers heat to outside air and raises temperature thereof.

Accordingly, as temperature of air sent to the heating unit 32 becomes higher than that of outside air, time required for raising temperature by the heating unit 32 to obtain hot air at a set temperature may be reduced.

Moreover, as exhausted heat from the drying furnace 20 of the hot air dryer 2 is reused, a heater capacity (electrical capacity) of the heating unit 32 can be suppressed.

In view of these, stability of temperature control of the heating unit 32 may be improved, and temperature of the hot air blown from the hot air blowing duct 25 can be made stabilized.

Figure 2:
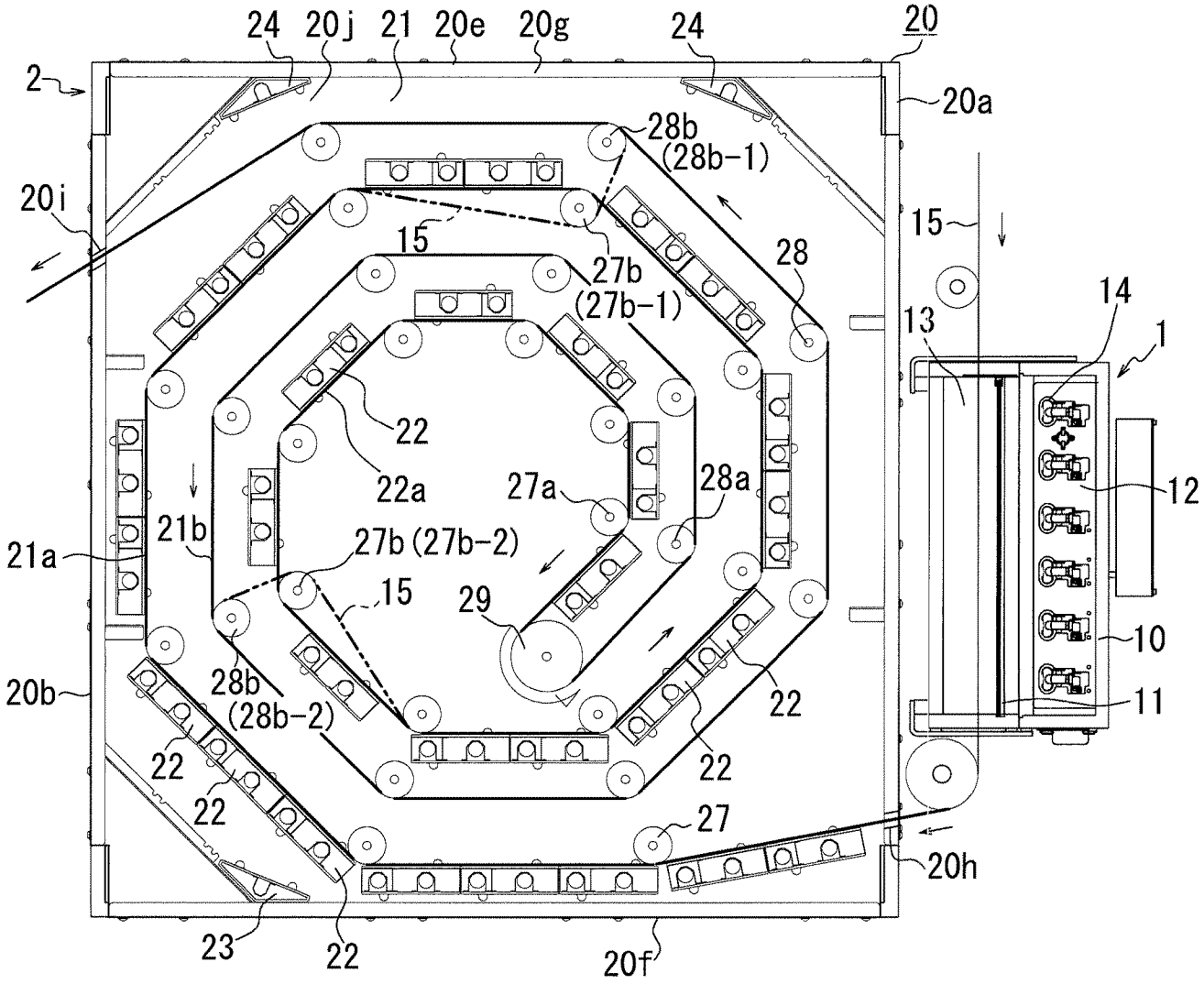
FIG. 2 is a detailed and enlarged sectional view of the ink drying apparatus taken along a line I-I of FIG. 1.

Details of the infrared dryer 1 will be described with reference to FIG. 2. FIG. 2 is a detailed and enlarged sectional view of the ink drying apparatus taken along a line I-I of FIG. 1, that is, the sectional view of the infrared dryer 1 and the hot air dryer 2 taken along a direction perpendicular to the substrate conveying direction.

In the infrared dryer 1, the drying furnace 10 is internally divided into a heater attaching part 12 and a drying chamber 13 by a heat resistant light transmission member 11. Heaters 14 are attached to the heater attaching part 12, and a substrate 15 passes through the inside the drying chamber 13 from an upper side to a lower side. The substrate 15 is a continuous and an elongated member, and the substrate 15 is continuously conveyed with its surface on which ink is ejected being opposed to the heat resistant light transmission member 11.

A carbon heater, a halogen heater and the like are usable as the heaters 14. A heat resistant glass and a heat resistant stainless mesh etc. are usable as the heat resistant light transmission member 11. The substrate 15 on which ink is ejected by the printer not shown passes through the inside the drying chamber 13 from the upper side to the lower side. At that time, ink is heated and raised in temperature by receiving infrared ray of the heaters 14. The substrate 15 never be in contact with the heaters 14 owing to the heat resistant light transmission member 11, even if it is broken during passing through the drying chamber 13.

Details of the hot air dryer 2 will be described with reference to FIG. 2.

The inside the drying furnace 20 is covered with a heat resistant member 20*g* as shown in FIG. 2.

In the drying furnace 20, there are formed an inlet 20*h* in a lower position of the first side wall 20*a* (a position closer to the lower wall 20*f*) and an outlet 20*i* in an upper position of the second side wall 20*b* (a position closer to the upper wall 20*e*). The inlet 20*h* and the outlet 20*i* are formed with slits through which the substrate 15 passes.

The substrate conveying path 21 has a spiral shape comprising a forward spiral path 21*a* having a diameter gradually decreasing from an outer position facing to the inlet 20*h* inside the drying furnace 20 toward an inner position closer to a center inside the drying furnace 20, and a return spiral path 21*b* having a diameter gradually increasing from an inner end portion of the forward path 21*a* toward an outer position facing to the outlet 20*i* inside the drying furnace 20.

The forward path 21*a* and the return path 21*b* have spiral shapes mutually turned toward the opposite directions and are alternately positioned so as not to cross each other.

In FIG. 2, the forward path 21*a* has a spiral shape in clockwise direction, and the return path 21*b* has a spiral shape in counter-clockwise direction.

A plurality of substrate drying ducts 22 are provided along the forward path 21*a*, and hot air blowing ducts 25 and exhausting ducts 26 are alternately positioned in the substrate conveying direction. No substrate drying duct 22 is provided on the return path 21*b*.

The substrate conveying path 21 is not formed in a continuous spiral shape, but comprises the forward spiral path 21*a* formed by a plurality of rollers 27 for forward path arranged at intervals along a virtual continuous spiral line for forward path (not shown) which is continuous from an outer position to an inner position, and the return spiral path 21*b* formed by a plurality of rollers 28 for return path arranged at intervals along a virtual continuous spiral line for return path (not shown) which is continuous from the inner position to the outer position.

A reversing roller 29 is provided between the roller 27*a* for forward path located at an innermost position and the roller 28*a* for return path located at an innermost position, such that the substrate 15 conveyed along the forward path 21*a* may be smoothly transferred to the return path 21*b*.

In other words, as the forward path 21*a* and the return path 21*b* have spiral shapes turned toward the opposite directions and the substrate 15 conveyed along the forward path 21*a* and the substrate 15 conveyed along the return path 21*b* are turned toward the opposite directions, the reversing roller 29 is provided such that the substrate 15 may smoothly be turned toward the opposite direction.

In FIG. 2, as the forward path 21*a* is turned in the clockwise direction and the return path 21*b* is turned in the counter-clockwise direction, the substrate 15 is conveyed in the counter-clockwise direction after having been conveyed in the clockwise direction.

There are provided the substrate drying ducts 22 between adjacent two rollers 27 for forward path in a conveying direction, between the inlet 20*h* and the first roller 27 for forward path, and between the roller 27*a* for forward path located at the innermost position and the reversing roller 29 respectively. A facing surface 22*a* of the substrate drying duct 22 facing to the surface of the substrate 15 on which ink is ejected has a liner flat shape.

In other words, as the substrate 15 conveyed between adjacent two rollers 27 for forward path in a conveying direction, the substrate 15 conveyed from the inlet 20*h* to the first roller 27 for forward path and the substrate 15 conveyed between the roller 27*a* for forward path located at the innermost position and the reversing roller 29 have the liner shape, the facing surface 22*a* of the substrate drying duct 22 is made liner flat.

Among distances between adjacent two rollers 27 for forward path, a distance is the longest at the position closer to the inlet 20*h*, the shortest at the position closer to the inner edge and intermediate at the intermediate position.

The longest distance corresponds to the length of the three substrate drying ducts 22, the intermediate distance corresponds to the length of two substrate drying ducts 22 and the shortest distance corresponds to the length of one substrate drying duct 22.

The distance between the adjacent two rollers 27 for forward path is accommodated to the length of the substrate drying duct 22, whereby the substrate drying ducts 22 can be consecutively provided in the forward path 21*a*.

The heat retaining duct 23 in drying furnace is provided at a lower part inside the drying furnace 20 and provided at a position closer to the outlet 20*i* at the lower part in the drying furnace 20 in FIG. 2. In other words, as a warm air flows upward, the heat retaining duct in drying furnace 23 is provided at the lower part in the drying furnace 20 such that hot air may flow over the whole area in the drying furnace 20.

The exhausting ducts in drying furnace 24 are provided at the upper part inside the drying furnace 20 for facilitating exhaustion of warm air. In FIG. 2, the exhausting ducts 24 in drying furnace are provided on the inlet 20*h* side and the outlet 20*i* side at the upper part inside the drying furnace 20 respectively.

An ink drying operation of the hot air dryer 2 is as follows.

The substrate 15 is conveyed from the inlet 20*h* to the forward path 21*a*, then conveyed toward the reversing roller 29 along the forward path 21*a*. In other words, the substrate 15 is conveyed with a surface being opposite to the surface on which ink is ejected being in contact with the roller 27 for forward path.

Hot air is blown to the surface of the substrate 15 from positions closer to an upstream in the substrate conveying direction of the substrate drying duct 22 (hot air blowing duct 25) while the substrate 15 is conveyed along the forward path 21*a*, whereby ink is heated and dried by heat. Temperature of hot air is 60° C.-140° C.

Air surrounding an area on the substrate 15 to which hot air is blown is sucked toward downstream in the substrate conveying direction of the substrate drying ducts 22 (the exhausting ducts 26) and exhausted by the exhausting blower 40. At the same time, water vapor generated by heating ink is also exhausted.

Accordingly, since water vapor is immediately exhausted, an adhesion of water vapor to the substrate 15 may be hardly happened, water vapor may hardly be collected in the drying furnace 20.

The substrate 15 is reversed by the reversing roller 29 so as to turn its front side and back side upside down and is conveyed along the return path 21*b* to the outlet 20*i*, then to the outside the drying furnace 20 from the outlet 20*i*.

In other words, the substrate 15 is conveyed while keeping the surface to which ink is ejected in contact with the roller 28 for the return path. At this time, although hot air is no longer being blown to the surface on which ink is ejected, as the inside the drying furnace 20 is in high temperature condition, ink may be naturally dried.

Accordingly, as a conveying distance of the substrate is elongated even though the drying furnace 20 is compact, and the drying furnace 20 performs drying ink at low temperature and by taking a long time, thus aqueous ink ejected on the resin substrate 15 can be dried.

Moreover, as high temperature air in the drying furnace 20 and unexhausted water vapor through the substrate drying duct 22 (the exhausting ducts 26) are exhausted via the exhausting duct 24 in drying furnace, whereby the adhesion of water vapor to the substrate 15 may be even more hard to be happened, water vapor may be even more hard to be collected in the drying furnace 20.

As described above, when drying ink, the substrate conveying distance required for drying ink is changed in accordance with conditions such as the kind of the substrate 15, the kind of ink, and a coverage (a rate of ink discharge per unit area).

In general, the shorter substrate conveying distance is preferable from standpoints of a printing resistor, an amount of paper waste and a confirmation of production of print at an early stage and so on.

The substrate conveying path 21 shown in FIG. 2 has a structure enable to change a substrate conveying distance, the substrate conveying distance can be reduced if ink can be sufficiently dried in a shorter distance than the previously described substrate conveying distance.

Specifically, the substrate conveying path 21 is configured to be reduced in such a way that the substrate 15 can be stretched over from an intermediate roller 27*b* for forward path to an intermediate roller 28*b* for return path, that is, from the intermediate roller 27*b* for forward path being positioned upstream side of the roller 27*a* for forward path located at the innermost position to the intermediate roller 28*b* for return path being positioned downstream side of the roller for return path 28*a* located at the innermost position.

By constituting the substrate conveying path 21 in this way, the substrate 15 is conveyed by bypassing the reversing roller 29 as indicated by a two short dashes line, therefore the substrate conveying distance is reduced.

Furthermore, in FIG. 2, the conveying distance can be changed in two places, in other words, the substrate 15 can be stretched in the two places, where the substrate 15 is stretched from a first intermediate roller 27*b*-1 for forward path to a first intermediate roller 28*b*-1 for return path, and from a second intermediate roller 27*b*-2 for the forward path to a second intermediate roller 28*b*-2 for return path.

However, the places for changing the conveying distance are not limited to those places, further place for changing the substrate conveying distance may be selected in other place where the substrate 15 can be stretched from further intermediate roller 27*b* for forward path to further intermediate roller 28*b* for return path, unless an interference would not be occurred between the substrate 15 and the substrate drying duct 22 etc.

Figure 3:
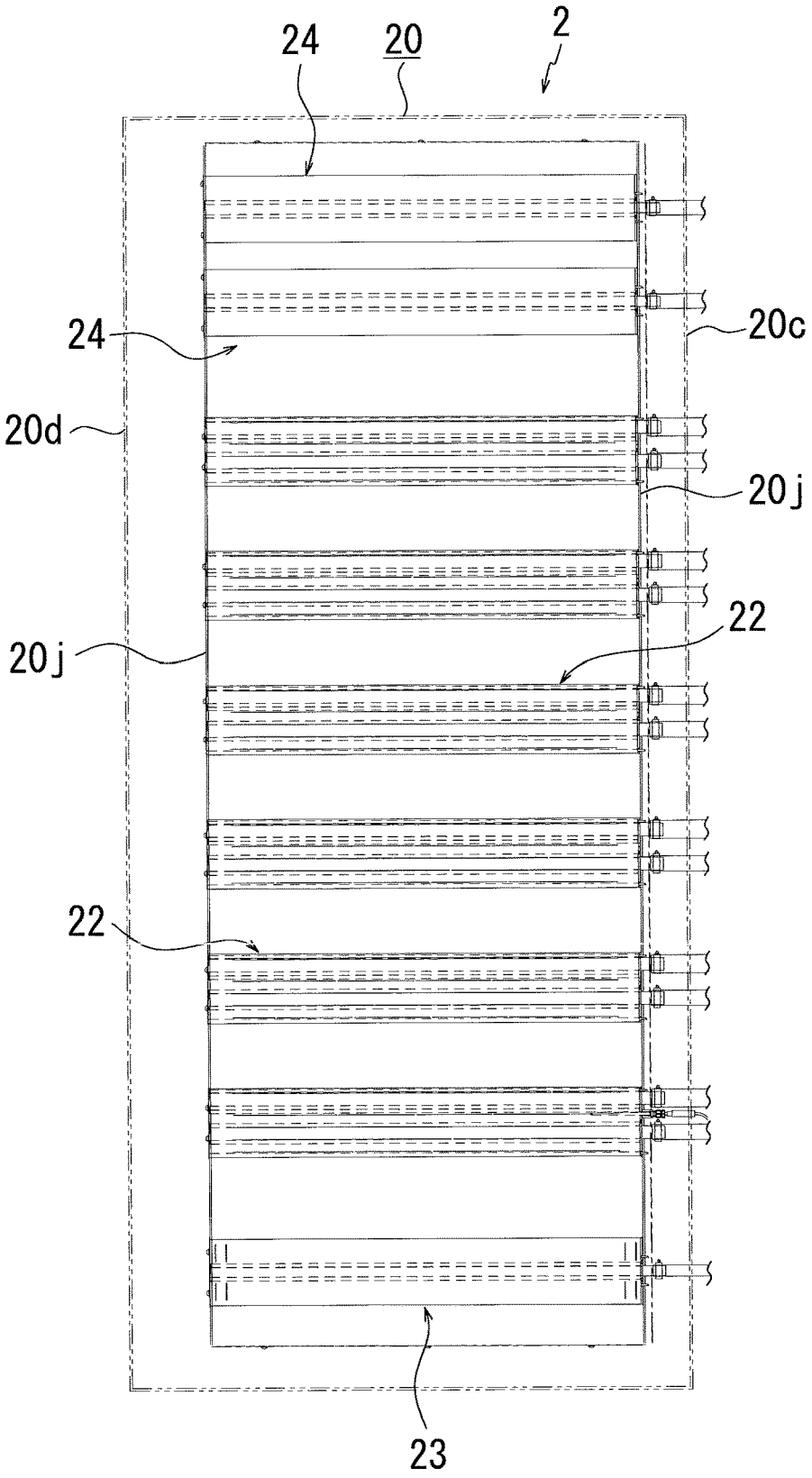
FIG. 3 is a sectional view of a hot air dryer taken along a direction perpendicular to a substrate conveying direction.

Attachment of each duct will be described with reference to FIG. 3. FIG. 3 is a sectional view of a hot air dryer taken along the direction perpendicular to the substrate conveying direction, in which the drying furnace 20 is indicated by a two short dashes line, and illustrations of the roller 27 for forward path, the roller 28 for return path and the reversing roller 29 are omitted.

As shown in FIG. 3, each of plates 20*j* is provided closer to the third side wall 20*c* and closer to the fourth side wall 20*d* in the drying furnace 20 respectively. The substrate drying duct 22, the heat retaining duct 23 in drying furnace and the exhausting duct 24 in drying furnace are attached between these plates 20*j* respectively. The substrate drying ducts 22, the heat retaining duct 23 in drying furnace and the exhausting duct 24 in drying furnace are illustrated as being in the same direction and arranged at an interval in the vertical direction, but in fact, they are attached to positions as shown in FIG. 2 in different directions.

Furthermore, the rollers 27 for forward path, the rollers 28 for return path and the reversing roller 29 are attached between the plates 20*j*.

Figure 4:
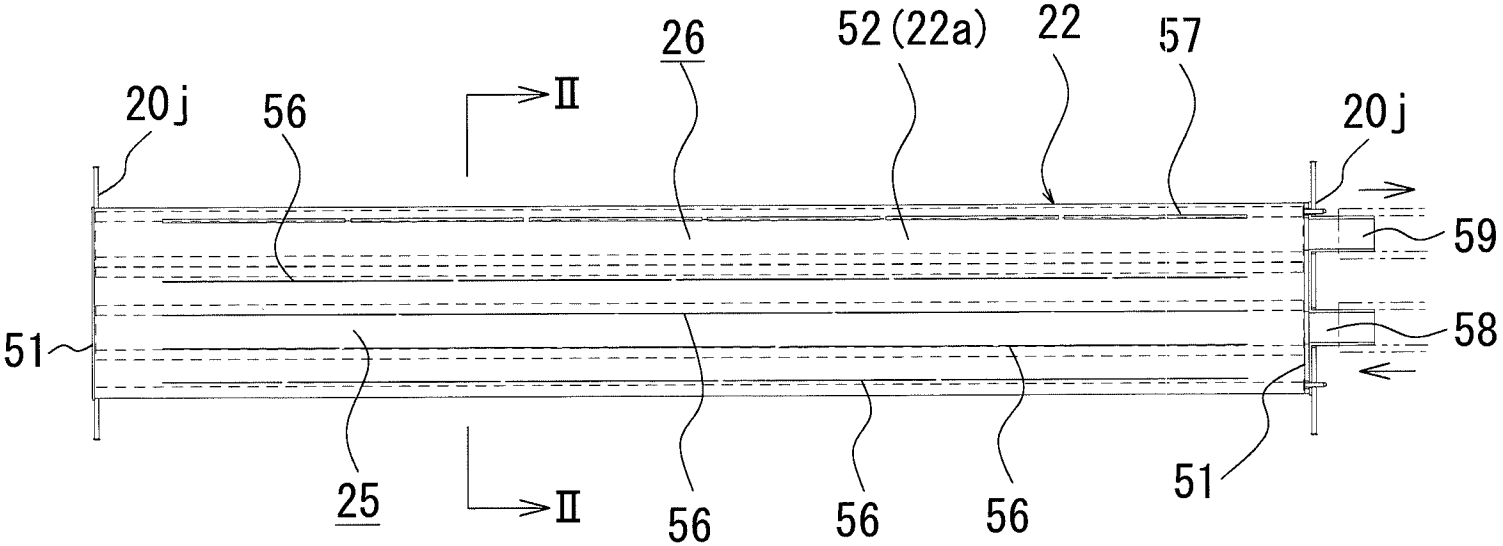
FIG. 4 is an enlarged front view showing a substrate drying duct shown in FIG. 3.
Figure 5:
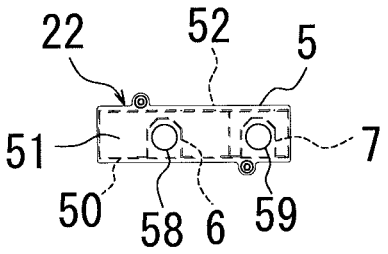
FIG. 5 is a side view showing the substrate drying duct shown in FIG. 4.
Figure 6:
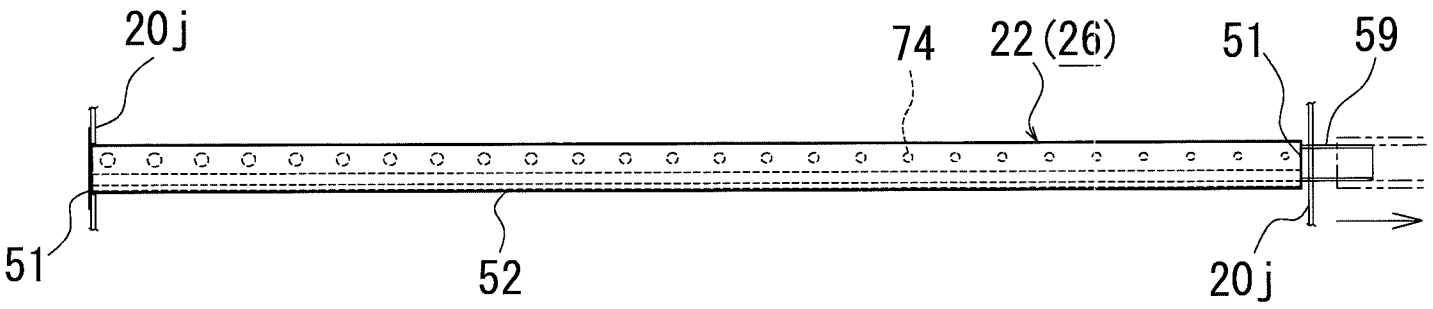
FIG. 6 is a plain view showing the substrate drying duct shown in FIG. 4.
Figure 7:
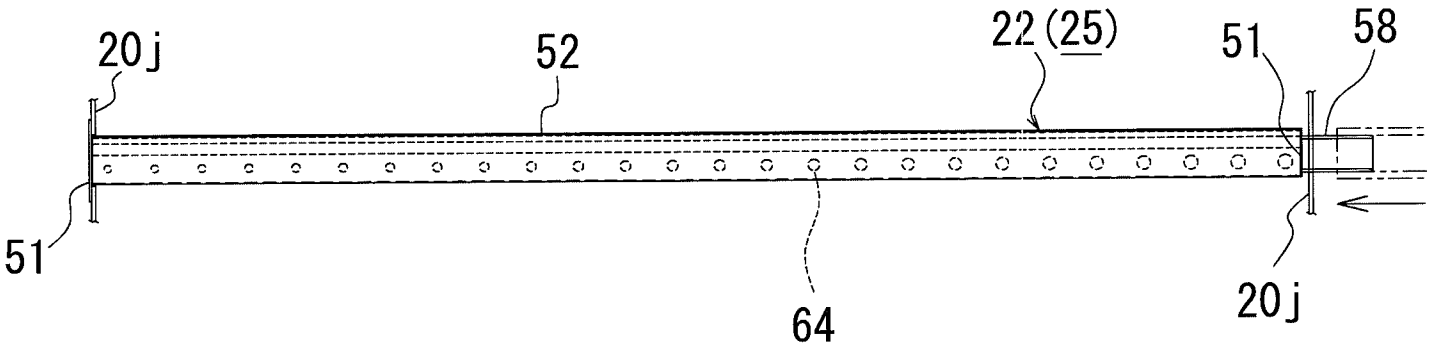
FIG. 7 is a bottom view showing the substrate drying duct shown in FIG. 4.
Figure 8:
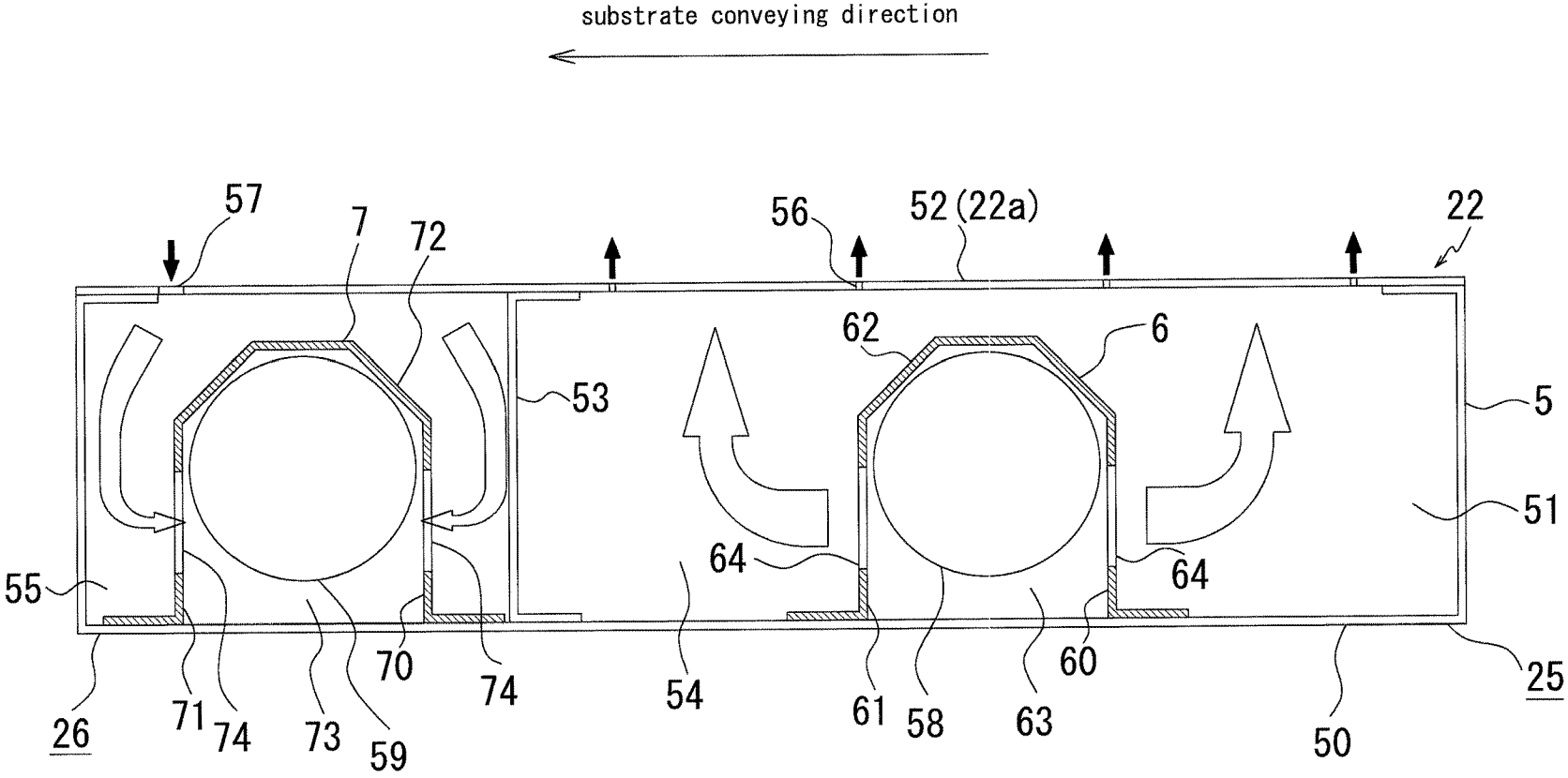
FIG. 8 is an enlarged sectional view showing the substrate drying duct taken along a line II-II of FIG. 4.

Details of the substrate drying duct 22 will be described with reference to FIG. 4-FIG. 8. FIG. 4 is an enlarged front view showing the substrate drying duct shown in FIG. 3, FIG. 5 is a side view showing the substrate drying duct shown in FIG. 4, FIG. 6 is a plain view showing the substrate drying duct shown in FIG. 4, FIG. 7 is a bottom view showing the substrate drying duct shown in FIG. 4, FIG. 8 is an enlarged sectional view showing the substrate drying duct taken along a line II-II of FIG. 4.

The substrate drying duct 22 has an outer duct 5. The outer duct 5 comprises an outer wall with an open face opposing to the substrate 15 and constituted by an elongated body plate 50 having an U-shaped cross section and two end plates 51 for sealing both ends of the longitudinal direction of the body plate 50, and a slit plate 52 covering the open face of the outer wall.

The substrate drying duct 22 is attached to the plates 20*j* by securing the end plates 51 of the outer duct 5. A longitudinal direction of the substrate drying duct 22 is perpendicular to the substrate conveying direction and the slit plate 52 is opposed to the surface of the substrate 15 on which ink is ejected. The slit plate 52 is the facing surface 22*a* of the substrate drying duct 22.

The outer duct 5 is internally divided into two spaces in the substrate conveying direction by a dividing panel 53, wherein a space on the upstream side in the substrate conveying direction is a hot air blowout space 54 and a space on the downstream side in the substrate conveying direction is an exhaust space 55.

The slit plate 52 is formed with hot air blowout slits 56 opened to the hot air blowout space 54 and a suction slit 57 opened to the exhaust space 55. The hot air blowout slit 56 plays a role as a hot air blowout port and the suction slit 57 plays a role as a sucking port.

Hot air in the hot air blowout space 54 is blown out of the hot air blowout slits 56. Ink ejected on the substrate 15 is heated and dried by such hot air.

Although water vapor is consequently generated, water vapor is collected in the exhaust space 55 through the suction slit 57.

As the hot air blowout space 54 and the exhaust space 55 are located next to each other, and water vapor generated may be immediately collected, adhesion of vapor to the inside the drying furnace 20 and the substrate 15 can be minimized.

An inner hot air supplying duct 6 is provided in the hot air blowout space 54. The inner hot air supplying duct 6 is elongated and has an U-shaped cross section, and constituted by one side plate 60, the other side plate 61 and a connecting plate 62. The one side plate 60 and the other side plate 61 are attached to the body plate 50, a hot air supply space 63 is constituted by the body plate 50 and the inner hot air supplying duct 6.

Hot air is supplied from a connecting and supplying port 58 formed in one end plate 51 toward one end of the hot air supply space 63 in a longitudinal direction. Other end of the hot air supply space 63 in its longitudinal direction is sealed by the other end plate 51.

There are formed a plurality of supplying holes 64 through which hot air flows at an interval in the one side plate 60 and the other side plate 61.

As hot air from the supplying holes 64 in the one side plate 60 is supplied to an upstream side of the hot air blowout space 54 in the substrate conveying direction, and hot air from the supplying holes 64 in the other side plate 61 is supplied to a downstream side of the hot air blowout space 54 in the substrate conveying direction, hot air is uniformly supplied throughout the whole area of the hot air blowout space 54 in the substrate conveying direction.

An opening area of each supplying hole 64 is increased toward the connecting and supplying port 58, as shown in FIG. 7, then, an amount of hot air flowing from each supplying hole 64 into the hot air blowout space 54 is uniform.

In general, when air is supplied from the other end of a tubular object sealed at one end, air pressure is likely to be more increased in the vicinity of a sealed place, therefore, if the opening area of each supplying hole 64 of the inner hot air supplying duct 6 is the same, much more amount of hot air would flow out of the supplying hole 64 located near the position sealed by the other end plate 51, accordingly, the opening area of each supplying hole 64 is varied so that the amount of hot air flown from each supplying hole 64 may be equalized.

Hot air flowing out of the supplying holes 64 of the inner hot air supplying duct 6 into the hot air blowout space 54 is blown out of the hot air blowout slits 56.

Accordingly, the hot air blowing duct 25 is formed by a part forming the hot air blowout space 54 of the outer duct 5 and the inner hot air supplying duct 6.

As the hot air blowing duct 25 has a double structure of the outer duct 5 forming the hot air blowout space 54 and the inner hot air supplying duct 6 forming the hot air supply space 63, hot air can be uniformly blown out of a plurality of hot air blowout slits 56.

In other words, as hot air supplied into the inner hot air supplying duct 6 is supplied from the supplying holes 64 into the outer duct 5, hot air is uniformly supplied throughout the whole area inside the outer duct 5.

By contrast, if hot air is directly supplied into the outer duct 5, hot air could not be spread to places at distances from a supplying place.

In addition, as the opening areas of the supplying holes 64 are decreased as separating from the supplying place (the connecting and supplying port 58), hot air can be more uniformly supplied throughout the whole area inside the outer duct 5.

An inner exhausting duct 7 is provided in the exhaust space 55. The inner exhausting duct 7 is elongated and has an U-shaped cross section, and constituted by one side plate 70, the other side plate 71 and a connecting plate 72, the one side plate 70 and the other side plate 71 are attached to the body plate 50, an air suction space 73 is constituted by the body plate 50 and the inner exhausting duct 7. The air suction space 73 is opened to a connecting and exhausting port 59 formed in the one endplate 51 at one side in the longitudinal direction thereof, and the air suction space 73 is sealed by the other end plate 51 at the other side in the longitudinal direction thereof.

A plurality of sucking holes 74 are formed in the one side plate 70 and the other side plate 71 at an interval in the longitudinal direction.

As air in the exhaust space 55 on an upstream side in the substrate conveying direction is sucked from the sucking holes 74 in the one side plate 70 and air in the exhaust space 55 on an downstream side in the substrate conveying direction is sucked from the sucking holes 74 in the other side plate 71, air can be uniformly sucked from the whole area of the exhaust space 55 in the substrate conveying direction.

An opening area of each sucking hole 74 is increased as approaching to the sealed other end as shown in FIG. 6, then the amount of air sucked from each sucking hole 74 is uniform.

In general, when air is sucked from the other end of a tubular object sealed at one end, an air pressure is likely to be more decreased in the vicinity of a sealed place, therefore, if the opening area of each sucking hole 74 of the inner exhausting duct 7 is the same, a small amount of air would be sucked from the sucking holes 74 located near the position sealed by the other end plate 51, therefore, the opening area of each sucking hole 74 is varied so that the amount of air sucked from each sucking hole 74 may be equalized.

Accordingly, the exhausting duct 26 is formed by a part forming the exhaust space 55 of the outer duct 5 and the inner exhausting duct 7.

As the exhausting duct 26 has a double structure of the outer duct 5 forming the exhaust space 55 and the inner exhausting duct 7 forming the air suction space 73, high temperature air containing water vapor can be uniformly sucked from a plurality of suction slits 57.

In other words, as high temperature air containing water vapor in the outer duct 5 is sucked from the sucking holes 74 of the inner exhausting duct 7, high temperature air containing water vapor can be sucked from the whole area inside the outer duct 5.

In addition, as the opening area of each sucking hole 74 is increased as separating from a sucking place (connecting and exhausting port 59), high temperature air containing water vapor can be uniformly sucked from the whole area inside the outer duct 5.

Whereas, if high temperature air containing water vapor in the outer duct 5 is directly sucked, as an amount of suction in a place at a distance from the sucking place would be smaller than that at a place near the sucking place, high temperature air containing water vapor could not be uniformly sucked.

As the hot air blowing duct 25 and the exhausting duct 26 are constituted by internally dividing the outer duct 5 into two spaces, the substrate drying duct 22 can be made compact and reduced in cost.

Furthermore, the outer duct 5 of the hot air blowing duct 25 and the outer duct 5 of the exhausting duct 26 may be formed separately.

The heat retaining duct 23 in drying furnace will be described with reference to FIG. 9-FIG. 11.

Figure 9:
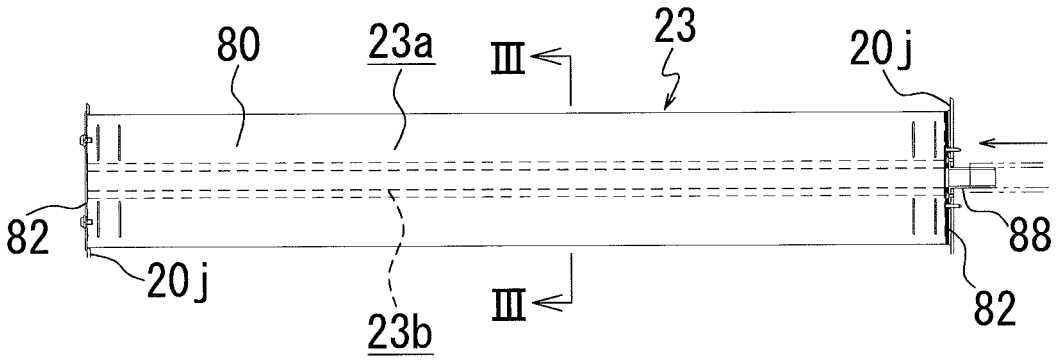
FIG. 9 is an enlarged front view showing a heat retaining duct in drying furnace shown in FIG. 3.
Figure 10:
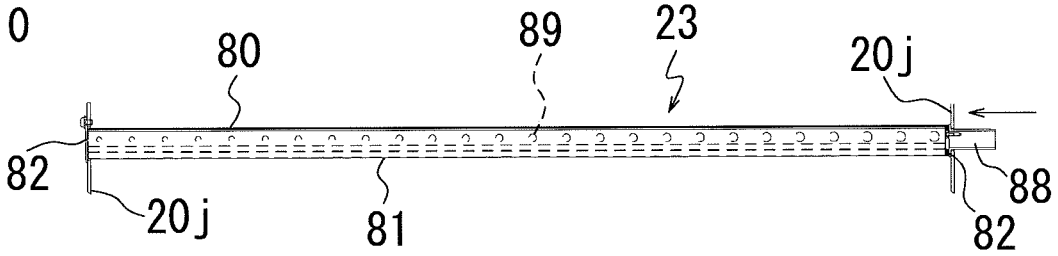
FIG. 10 is a bottom view showing the heat retaining duct in drying furnace shown in FIG. 9.
Figure 11:
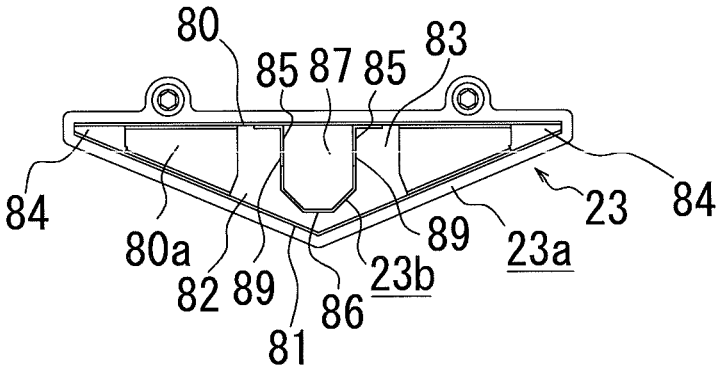
FIG. 11 is an enlarged sectional view showing the heat retaining duct in drying furnace taken along a line III-III of FIG. 9.

FIG. 9 is an enlarged front view showing the heat retaining duct in drying furnace shown in FIG. 3, FIG. 10 is a bottom view showing the heat retaining duct in drying furnace shown in FIG. 9, FIG. 11 is an enlarged sectional view showing the heat retaining duct in drying furnace taken along a line III-III of FIG. 9.

The heat retaining duct 23 in drying furnace is constituted as shown in FIG. 9-FIG. 11, although it may be similarly constituted as the hot air blowing duct 25.

The heat retaining duct 23 in drying furnace is provided with an outer duct 23*a* and an inner duct 23*b* provided in the outer duct 23*a*. The outer duct 23*a* forms a blowout space 83 by one side plate 80, the other side plate 81 and two end plates 82.

The one side plate 80 is an elongated and narrow plane plate, the other side plate 81 is an elongated, narrow and folded plate in a chevron shape in a width direction, and the one side plate 80 and the other side plate 81 are connected by a stay 80*a*. Both ends of the one side plate 80 in the widthwise direction and both ends of the other side plate 81 in the widthwise direction are located separately such that a blowout port 84 in the shape of slit is formed.

The inner duct 23*b* is formed into a shape having an U-shaped cross section by the two side plates 85, 85 and a connecting plate 86, and a hot air supply space 87 is formed by securing the two side plates 85, 85 to the one side plate 80 of the outer duct 23*a*.

One side of the hot air supply space 87 in the longitudinal direction is opened to a connecting and supplying port 88 formed in one end plate 82 at one side of the outer duct 23*a*, hot air is supplied from the connecting and supplying port 88. The hot air supply space 87 is sealed by the other end plate 82 at the other side in the longitudinal direction thereof.

There are formed with a plurality of supplying holes 89 in the two side plates 85, 85 of the inner duct 23*b* at an interval in the longitudinal direction, and hot air is supplied to the blowout space 83 from each supplying hole 89.

An opening area of each supplying hole 89 is increased toward the connecting and supplying port 88 so that an amount of hot air supplied from each supplying hole 89 may be equalized.

In the heat retaining duct 23 in drying furnace, two end plates 82 of the outer duct 23*a* are securely attached to the plate 20*j*, and a longitudinal direction of the outer duct 23*a* is perpendicular to the substrate conveying direction.

Thus constituted, the heat retaining duct 23 in drying furnace can uniformly blow out hot air to the direction perpendicular to the substrate conveying direction in the drying furnace 20.

The exhausting duct 24 in drying furnace will be described with reference to FIG. 12-FIG. 14.

Figure 12:
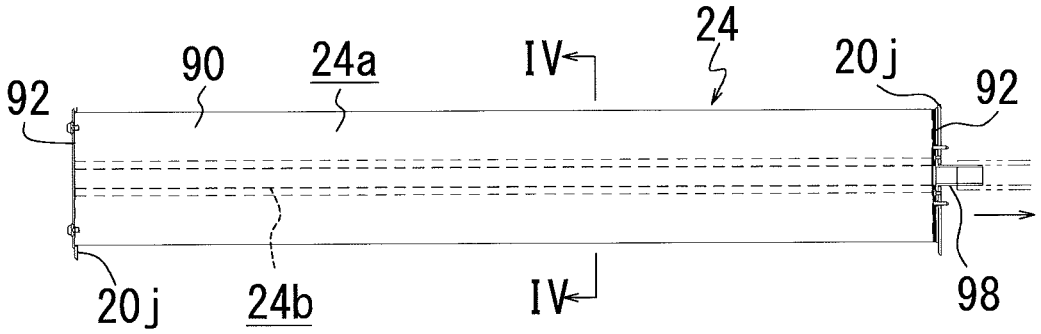
FIG. 12 is an enlarged front view showing an exhausting duct in drying furnace shown in FIG. 3.
Figure 13:
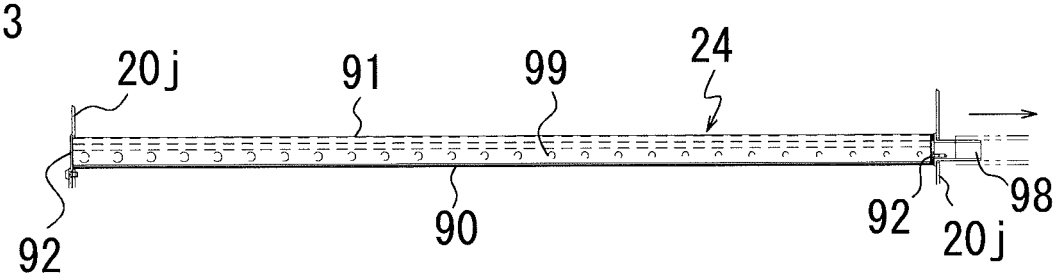
FIG. 13 is a plain view showing the exhausting duct in drying furnace shown in FIG. 12.
Figure 14:
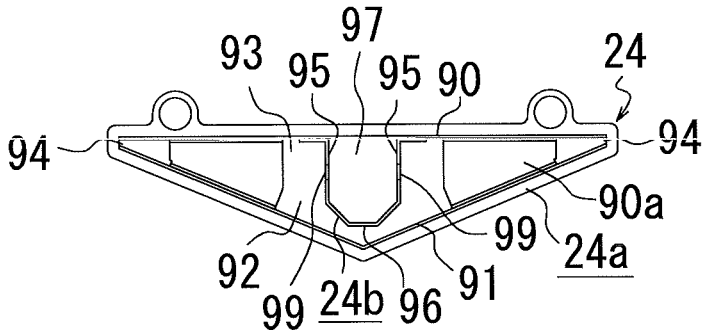
FIG. 14 is an enlarged sectional view showing the exhausting duct in drying furnace taken along a line IV-IV of FIG. 12.

FIG. 12 is an enlarged front view showing the exhausting duct in drying furnace shown in FIG. 3, FIG. 13 is a plain view showing the exhausting duct in drying furnace shown in FIG. 12, FIG. 14 is an enlarged sectional view showing the exhausting duct in drying furnace taken along a line IV-IV of FIG. 12.

The exhausting duct 24 in drying furnace is constituted as shown in FIG. 12-FIG. 14, although it can be similarly constituted as the exhausting duct 26. In other words, the exhausting duct 24 in drying furnace has a same constitution as the heat retaining duct 23 in drying furnace.

The exhausting duct 24 in drying furnace is provided with an outer duct 24*a* and an inner duct 24*b* provided in the outer duct 24*a*. The outer duct 24*a* forms an exhaust space 93 by one side plate 90, the other side plate 91 and two end plates 92.

The one side plate 90 is an elongated and narrow plane plate, the other side plate 91 is a narrow and elongated plate folded in a chevron shape in a width direction, and the one side plate 90 and the other side plate 91 are connected by the stay 90*a*. Both ends of the one side plate 90 in the widthwise direction and both ends of the other side plate 91 in the widthwise direction are located separately such that a sucking port 94 in the shape of slit is formed.

The inner duct 24*b* is formed into a shape having an U-shaped cross section by the two side plates 95, 95 and a connecting plate 96, and an air suction space 97 is formed by securing the two side plates 95, 95 to the one side plate 90 of the outer duct 24*a*.

One side of the air suction space 97 in the lengthwise direction is opened to a connecting and exhausting port 98 formed in one end plate 92 of the outer duct 24*a*, and air is sucked from the connecting and exhausting port 98. The air suction space 97 is sealed by the other end plate 92 at the other end in the longitudinal direction thereof.

There are formed with a plurality of sucking holes 99 in the two side plates 95, 95 of the inner duct 24*b* at an interval in the longitudinal direction, air in the exhaust space 93 is sucked from each sucking hole 99.

An opening area of each sucking hole 99 is increased toward the sealed other end so that the amount of air suck from each sucking hole 99 may be equalized.

In the exhausting duct 24 in drying furnace, two end plates 92 of the outer duct 24*a* are securely attached to the plates 20*j*, and the longitudinal direction of the outer duct 24*a* is perpendicular to the substrate conveying direction.

Thus constituted, the exhausting duct 24 in drying furnace can uniformly suck air from a direction orthogonal to the substrate conveying direction in the drying furnace 20.

Figure 15:
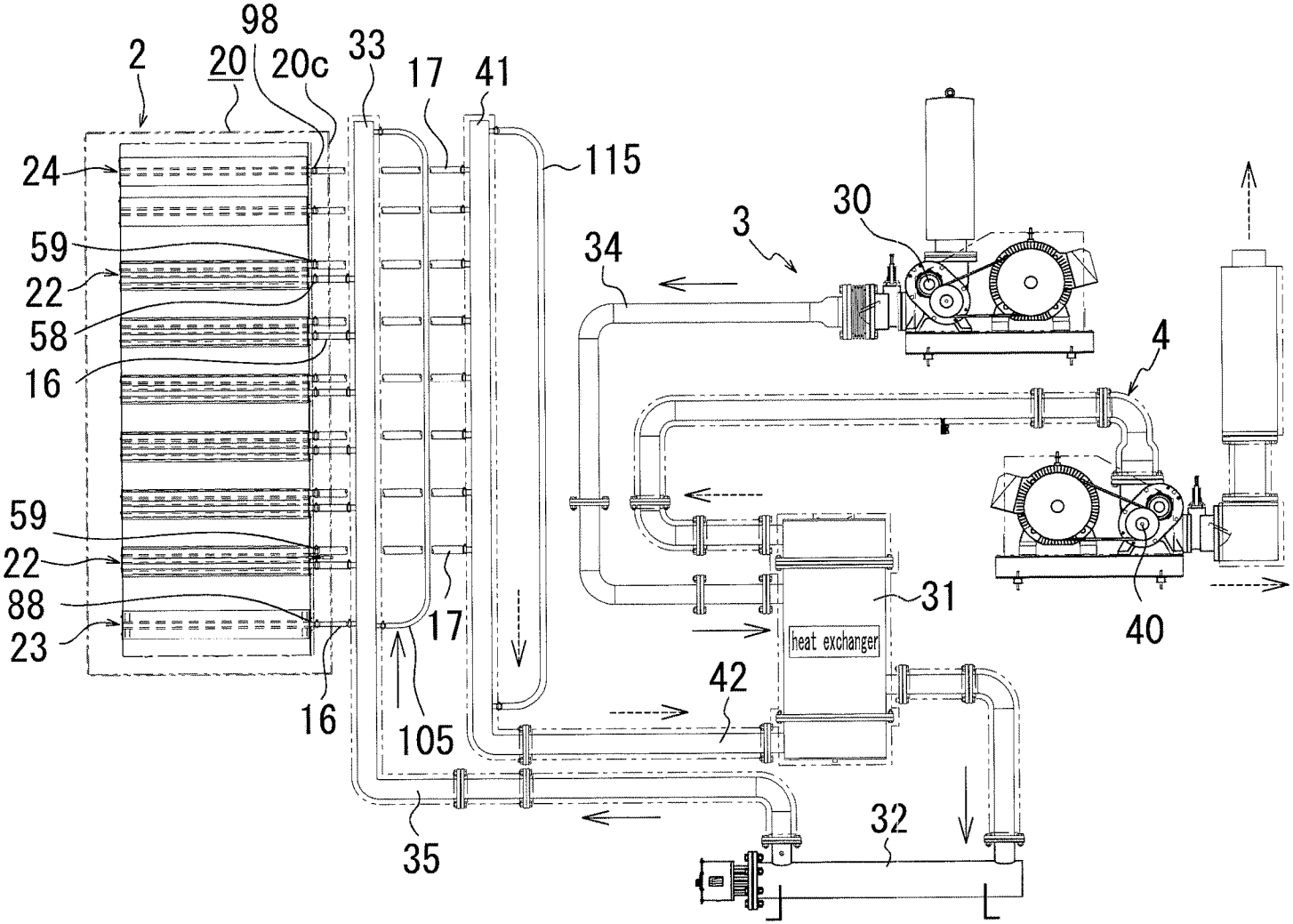
FIG. 15 is an explanatory view showing a hot air supplying part and an exhausting part.

The hot air supplying part 3 and the exhausting part 4 will be described with reference to FIG. 15 and FIG. 16. FIG. 15 is an explanatory view of the hot air supplying part and the exhausting part, and FIG. FIG. 16 is a front view of a heat exchanger.

As shown in FIG. 15, a spiral hot air supplying pipe 33 is provided adjacent to the third side wall 20*c* in the drying furnace 20 of the hot air dryer 2 and to which a plurality of supplying tubes 16 are connected. The supplying tubes 16 are connected to the connecting and supplying port 58 of each substrate drying duct 22 and the connecting and supplying port 88 of the heat retaining duct 23 in drying furnace respectively, and supply hot air to the substrate drying ducts 22 and the heat retaining duct 23 in drying furnace.

There is provided a spiral exhausting pipe 41 adjacent to the opposite side of the drying furnace 20 with respect to the spiral hot air supplying pipe 33 and to which a plurality of exhausting tubes 17 are connected. The exhausting tubes 17 are connected to the connecting and exhausting port 59 of each substrate drying duct 22 and the connecting and exhausting port 98 of each exhausting duct 24 in drying furnace and suck high temperature air containing water vapor from the substrate drying ducts 22 and the exhausting ducts 24 in drying furnace.

Figure 16:
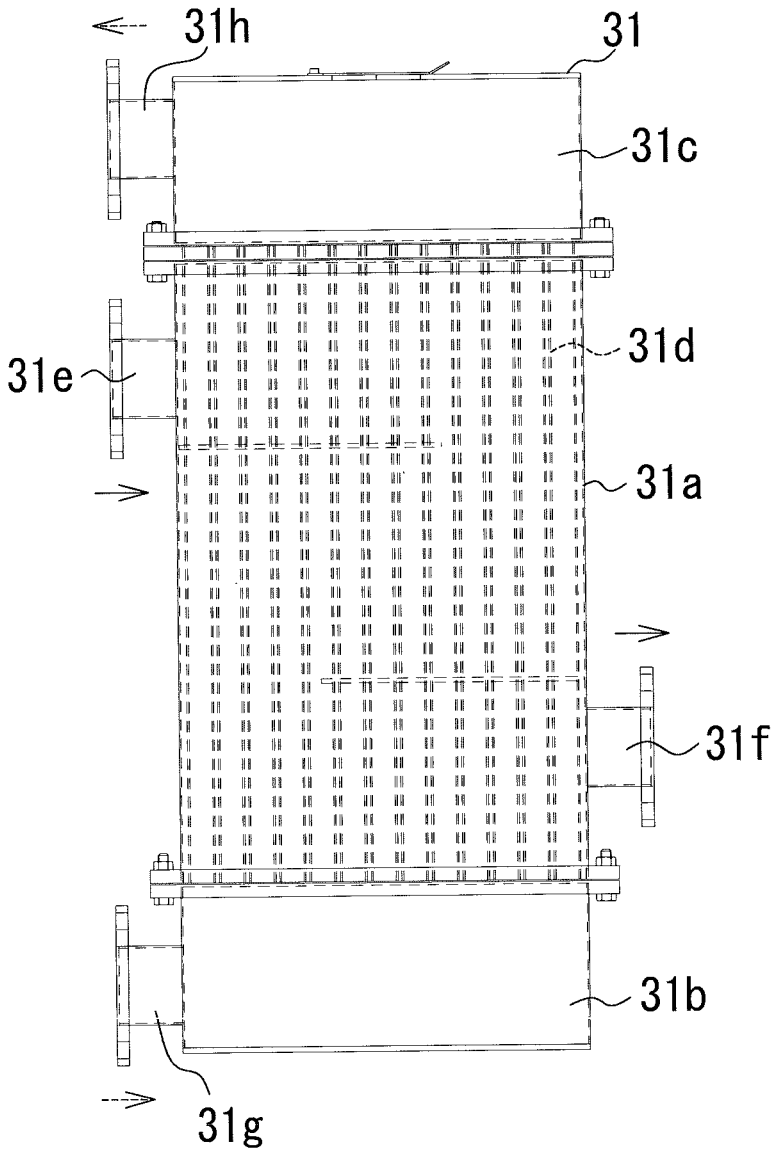
FIG. 16 is a front view showing a heat exchanger.

As shown in FIG. 16, a heat exchanger 31 is constituted by a central shell 31*a*, a bonnet 31*b* on an inflow side located at one end of the shell 31*a* and a bonnet 31*c* on an outflow side located at the other end of the shell 31*a*. The bonnet 31*b* on the inflow side is communicated with the bonnet 31*c* on the outflow side through a plurality of tubes 31*d*.

Air supplied from the air supplying blower 30 is exhausted to the heating unit 32 from an outlet 31*f* of the supplying path through the inside the shell 31*a* from an inlet 31*e* of the supplying path. On the other hand, high temperature air containing water vapor exhausted from the spiral exhausting pipe 41 flows into the heat exchanger 31 from an inlet 31*g* of the exhausting path of the bonnet 31*b* on the inflow side, then flows through the tube 31*d* and flows from the bonnet 31*c* on the outflow side toward the exhausting blower 40 through the inside an outlet 31*h* of the exhausting path.

In the shell 31*a* in the heat exchanger 31, temperature of air supplied from the air supplying blower 30 is raised through a contact with the tube 31*d* at high temperature. On the contrary, temperature of high temperature air containing water vapor flowing through the tube 31*d* is lowered.

Since temperature of air supplied from the air supplying blower 30 is raised, hot air can be produced using a smaller amount of heat and in a shorter time in comparison with a case of raising temperature by the heating unit 32 without using the heat exchanger 31.

Figure 17:
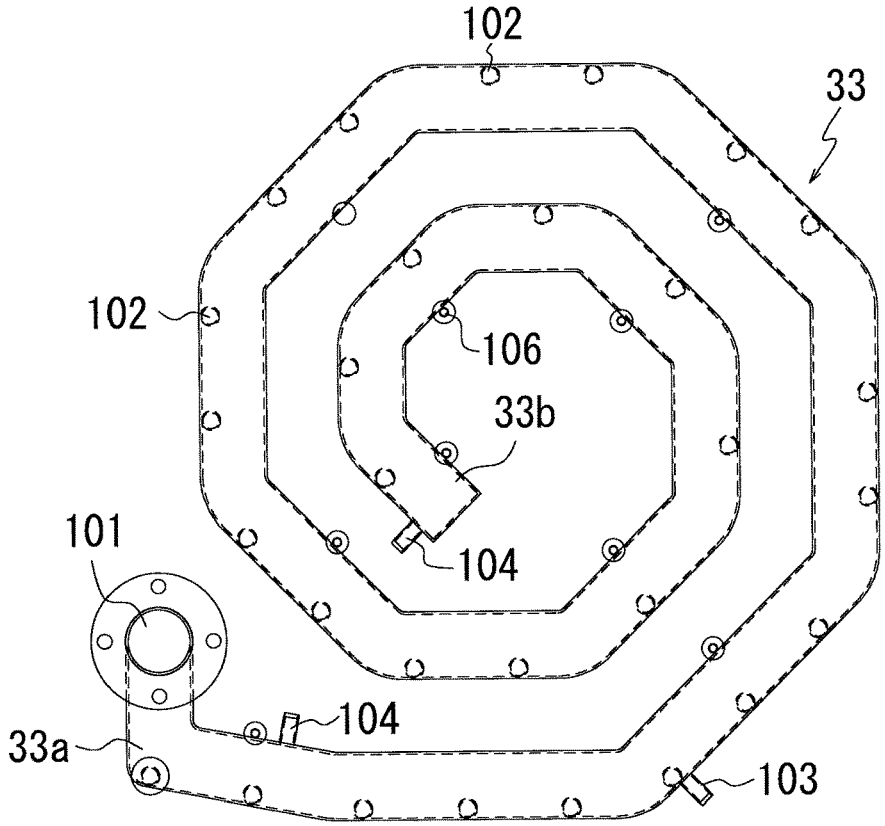
FIG. 17 is a front view of a spiral hot air supplying pipe.
Figure 18:
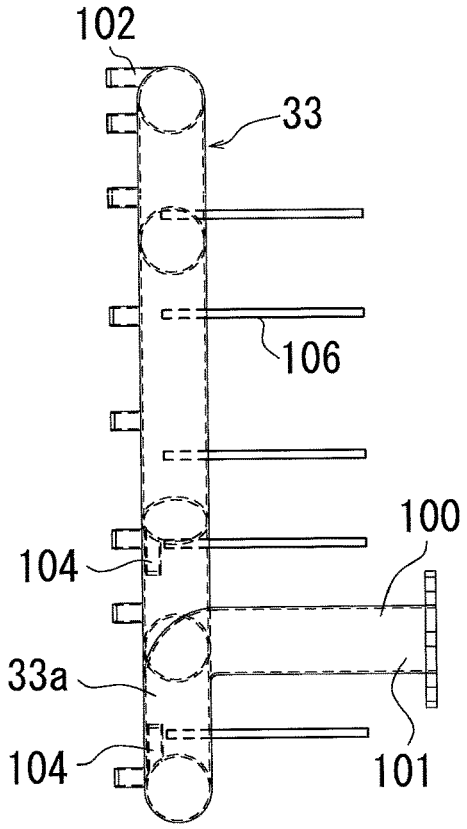
FIG. 18 is a left side view showing the spiral hot air supplying pipe shown in FIG. 17.

The spiral hot air supplying pipe 33 will be described with reference to FIG. 17 and FIG. 18. FIG. 17 is a front view of the spiral hot air supplying pipe. FIG. 18 is a left side view of the spiral hot air supplying pipe shown in FIG. 17.

As shown in FIG. 17 and FIG. 18, the spiral hot air supplying pipe 33 is formed in a spiral shape wound on a plane, and an outer end 33*a* and an inner end 33*b* are located on the same plane.

A supplying port 101 of a supplying pipe 100 is integrally provided at an outer end 33*a* of the spiral hot air supplying pipe 33, and the outer end 33*a* is a supplying end. The supplying pipe 100 projects at a right angle from the spiral hot air supplying pipe 33.

An inner end 33*b* of the spiral hot air supplying pipe 33 is sealed such that hot air supplied from the supplying port 101 may be collected, and the inner end 33*b* is a tip end.

Furthermore, the supplying port may be provided at the inner end 33*b* as the supplying end, and the outer end 33*a* may be the tip end by applying sealing thereto.

In the spiral hot air supplying pipe 33, a plurality of first connecting ports 102 supplying hot air to the substrate drying duct 22 are provided at an interval from the outer end 33*a* to the inner end 33*b*. In this embodiment, 29 pieces of the first connecting ports 102 are provided.

The spiral hot air supplying pipe 33 is provided with a second connecting port 103 for supplying hot air to the heat retaining duct 23 in drying furnace 23. Supplying tubes 16 are connected to the first connecting ports 102 and the second connecting port 103 respectively.

Third connecting ports 104 are provided at positions closer to the outer end 33*a* of the spiral hot air supplying pipe 33 and closer to the inner end 33*b* of the spiral hot air supplying pipe 33. A balance tube 105 shown in FIG. 15 is connected to these two third connecting ports 104 for communicating the outer end 33*a* with the inner end 33*b* of the spiral hot air supplying pipe 33 and thereby reducing the differences in temperature and pressure between the outer end 33*a* and the inner end 33*b*, such that temperature and pressure of hot air in the spiral hot air supplying pipe 33 are equalized.

In other words, the balance tube 105 is provided, because temperature and pressure are sequentially increased toward the inner end 33*b* from the outer end 33*a* by supplying hot air from the outer end 33*a* of the spiral hot air supplying pipe 33, with the inner end 33*b* of the spiral hot air supplying pipe 33 being sealed.

The spiral hot air supplying pipe 33 is provided with a plurality of attaching studs 106. The studs 106 project at a right angle from the spiral hot air supplying pipe 33.

Figure 19:
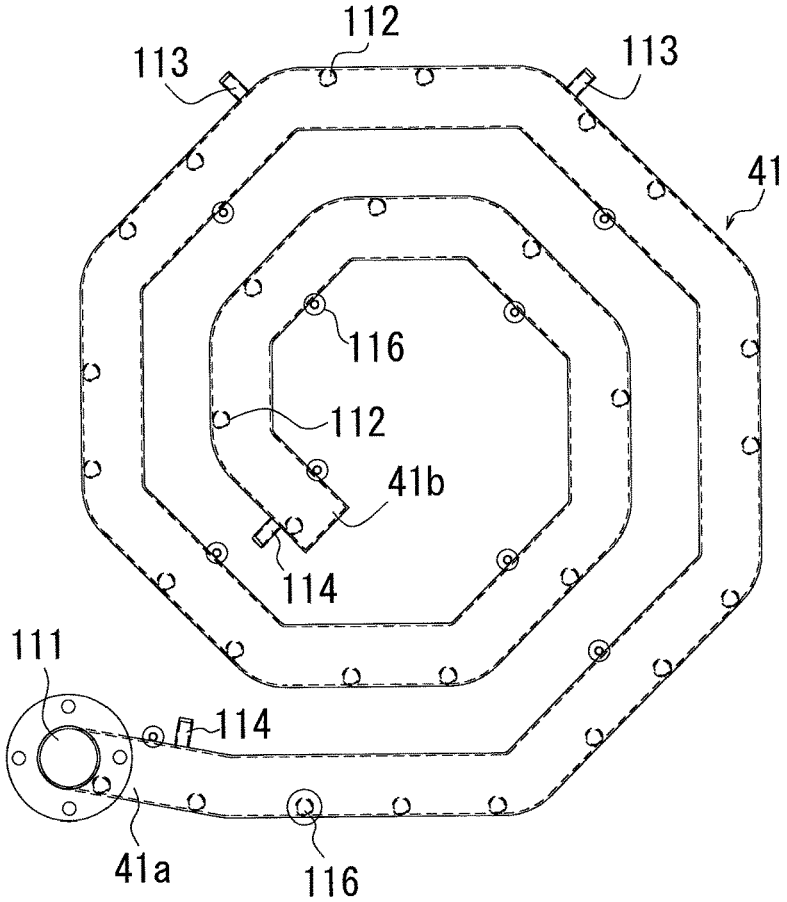
FIG. 19 is a front view showing a spiral exhausting pipe.

The spiral exhausting pipe 41 will be described with reference to FIG. 19 and FIG. 20. FIG. 19 is a front view of a spiral exhausting pipe, and FIG. 20 is a left side view of the spiral exhausting pipe shown in FIG. 19.

Figure 20:
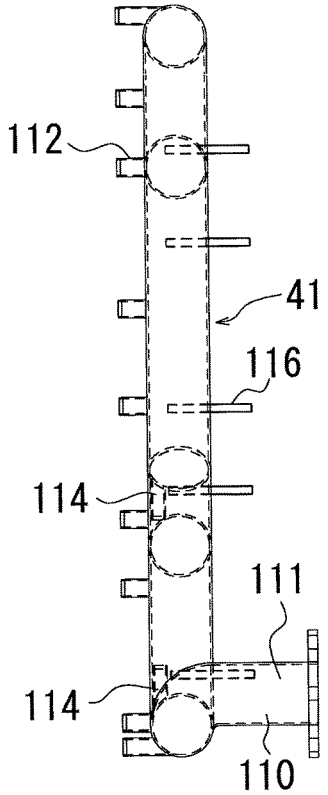
FIG. 20 is a left side view showing the spiral exhausting pipe shown in FIG. 19.

As shown in FIG. 19 and FIG. 20, the spiral exhausting pipe 41 is formed in a spiral shape wound in a plane, and an outer end 41*a* and an inner end 41*b* are located on the same plane. A supplying port 111 of a suction pipe 110 is integrally provided at the outer end 41*a* of the spiral exhausting pipe 41, and the outer end 41*a* is a suction end. The suction pipe 110 projects at a right angle from the spiral exhausting pipe 41.

An inner end 41*b* of the spiral exhausting pipe 41 is sealed, and the inner end 41*b* is a tip end. Furthermore, the sucking port may be provided at the inner end 41*b* as the suction end, and the outer end 41*a* may be the tip end when being sealed.

In the spiral exhausting pipe 41, a plurality of first connecting and sucking port 112 sucking air from the substrate drying duct 22 are provided at an interval from the outer end 41*a* to the inner end 41*b*. In this embodiment, 29 pieces of the first connecting and sucking port 112 are provided.

The spiral exhausting pipe 41 is provided with two second connecting and sucking port 113 for sucking air from the exhausting duct 24 in drying furnace. The first connecting and sucking port 112 and the second connecting and sucking port 113 are connected to the exhausting tube 17 respectively.

Connecting ports 114 are provided at positions closer to the outer end 41*a* of the spiral exhausting pipe 41 and closer to the inner end 41*b* of the spiral exhausting pipe 41. A balance tube 115 shown in FIG. 15 is connected to these two connecting ports 114 for communicating the outer end 41*a* with the inner end 41*b* of the spiral exhausting pipe 41 and thereby reducing the difference in pressure between the outer end 41*a* and the inner end 41*b*, such that pressure in the spiral exhausting pipe 41 are equalized.

In other words, the balance tube 115 is provided, because pressure (negative pressure) is sequentially increased toward the outer end 41*a* from the inner end 41*b* by sucking air from the outer end 41*a*, with the inner end 41*b* of the spiral exhausting pipe 41 being sealed.

The spiral exhausting pipe 41 is provided with a plurality of attaching studs 116. The studs 116 project at a right angle from the spiral exhausting pipe 41.

An attaching structure of the spiral hot air supplying pipe 33 and the spiral exhausting pipe 41 will be described with reference to FIG. 21 and FIG. 22.

Figure 21:
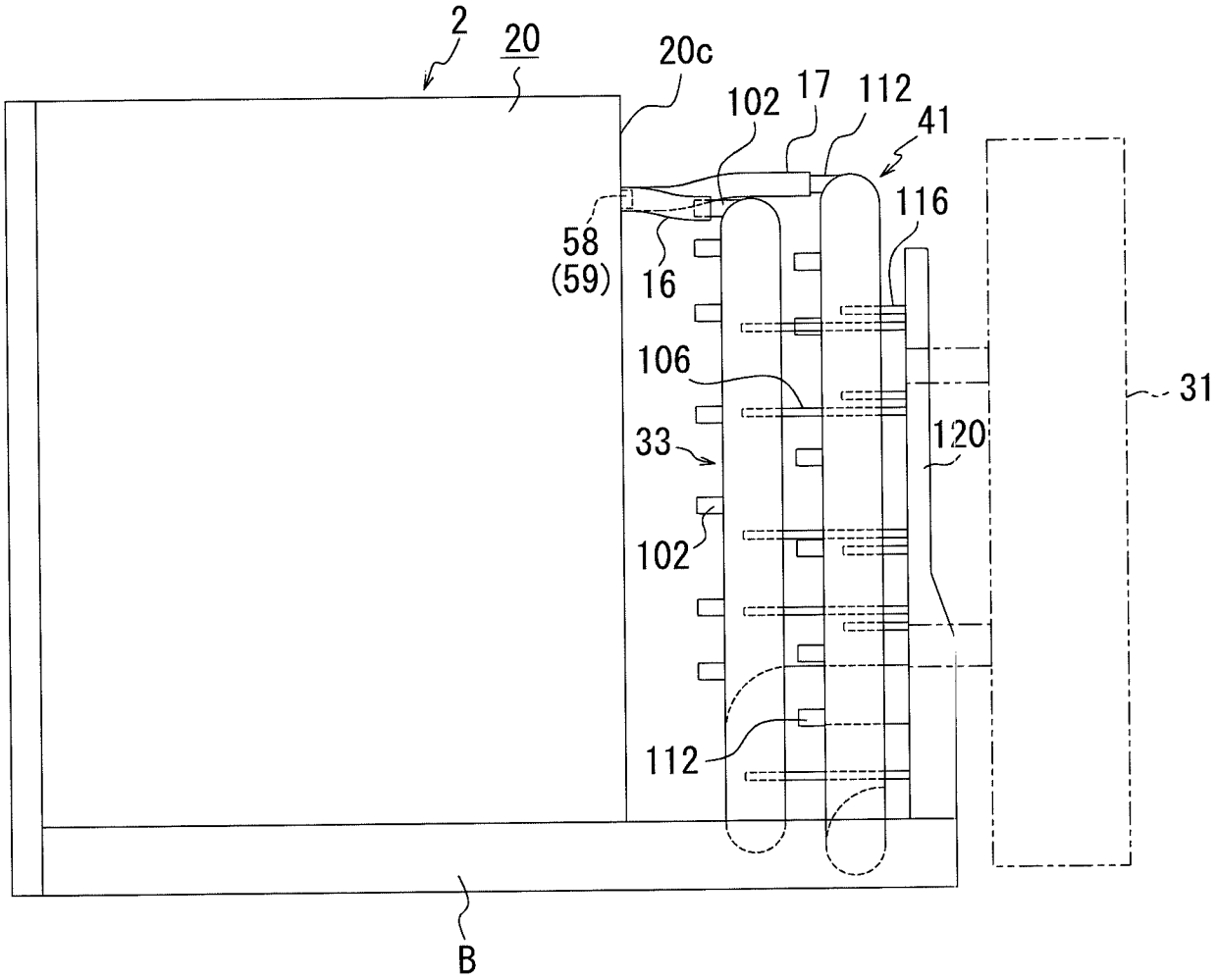
FIG. 21 is a side view showing the spiral hot air supplying pipe and the spiral exhausting pipe while being in the attached states.
Figure 22:
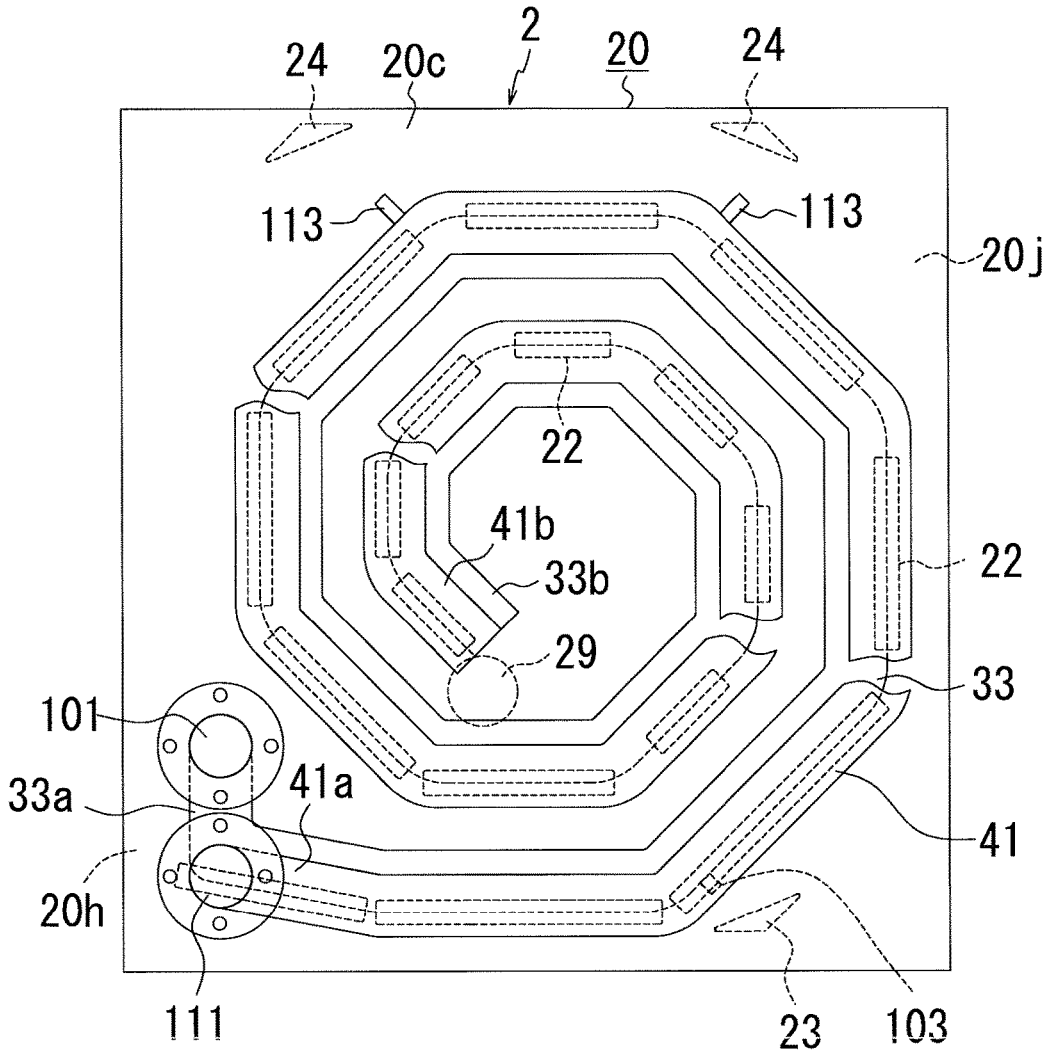
FIG. 22 is a front view of the spiral hot air supplying pipe and the spiral exhausting pipe while being attached.

FIG. 21 is a side view of the spiral hot air supplying pipe and the spiral exhausting pipe while being attached, and FIG. 22 is a front view of the spiral hot air supplying pipe and the spiral exhausting pipe while being attached.

Furthermore, the studs and a part of the connecting ports etc. are omitted, and a part of the spiral exhausting pipe 41 is ruptured in 4 places in FIG. 22.

As shown in FIG. 21, a bracket 120 is attached to the base B, and the spiral hot air supplying pipe 33 is attached to the base B by securing the studs 106 to the bracket 120. The spiral hot air supplying pipe 33 adjoins the third side wall 20*c* of the drying furnace 20, and the first connecting port 102 projects toward the third side wall 20*c*.

Accordingly, a connection work of the supplying tube 16 connected with the first connecting port 102 to the connecting and supplying port 58 projected from the third side wall 20*c* of the drying furnace 20 may be facilitated.

The spiral exhausting pipe 41 is attached to the base B by securing the studs 116 to the bracket 120. The spiral exhausting pipe 41 is located on an opposite side of the drying furnace 20 with respect to the spiral hot air supplying pipe 33, and the first connecting and sucking port 112 projects toward the spiral hot air supplying pipe 33.

Accordingly, a connection work of the exhausting tube 17 connected with the first connecting and sucking port 112 to the connecting and exhausting port 59 projected from the third side wall 20*c* of the drying furnace 20 may be facilitated.

The heat exchanger 31 is secured to the bracket 120.

As shown in FIG. 22, shapes of winding and sizes of the spiral hot air supplying pipe 33 and the spiral exhausting pipe 41 are same as shapes of winding and sizes of the plurality of substrate drying ducts 22 attached to the inside the drying furnace 20 in a shape of spiral. The spiral hot air supplying pipe 33 and the spiral exhausting pipe 41 are attached so as to overlap with the plurality of substrate drying ducts 22.

In other words, the spiral hot air supplying pipe 33 and the spiral exhausting pipe 41 are opposed to the substrate drying duct 22, in a place where the inner end 33*b* of the spiral hot air supplying pipe 33 and the inner end 41*b* of the spiral exhausting pipe 41 are opposed to the reversing roller 29, and in a place where the outer end 33*a* of the spiral hot air supplying pipe 33 and the outer end 41*a* of the spiral exhausting pipe 41 are opposed to a position near the inlet 20*h*.

The second connecting port 103 of the spiral hot air supplying pipe 33 is downward and opposed to the heat retaining duct 23 in drying furnace (the connecting and supplying port 88).

The two second connecting and sucking ports 113 of the spiral exhausting pipe 41 are upward and opposed to the exhausting duct 24 in drying furnace (the connecting and exhausting port 98).

Accordingly, lengths of the supplying tube 16 and the exhausting tube 17 can be reduced and connections can be easily conducted.

What is claimed is:

1. An ink drying apparatus comprising:

a hot air dryer;

a hot air supplying part; and an exhausting part, wherein:

the hot air dryer includes:

a drying furnace, a substrate conveying path that is a spirally shaped path provided in the drying furnace, and a plurality of substrate drying ducts including:

a hot air blowing duct configured to blow hot air to a surface of an inked substrate conveyed along the substrate conveying path to heat ink; and an exhaust duct configured to exhaust water vapor generated by heating of ink, the hot air blowing duct and the exhaust duct provided at a center of the drying furnace and arranged in a spiral shape, the hot air blowing duct provided on an upstream side in a substrate conveying direction and the exhaust duct located on a downstream side of the substrate conveying direction, the hot air supplying part is provided at an outside the drying furnace and configured to supply hot air into the substrate drying ducts, and the exhausting part is provided at the outside the drying furnace and configured to exhaust air in the drying furnace through the substrate drying ducts.

2. The ink drying apparatus according to claim 1, wherein the hot air supplying part has a hot air supplying pipe to which hot air is supplied and communicated with a hot air blowout space of each of the plurality of substrate drying ducts, and the exhausting part has an exhausting pipe from which air is suck and communicated with an air suction space of each of the plurality of substrate drying ducts.

3. The ink drying apparatus according to claim 2, wherein at least one of the hot air supplying pipe and the exhausting pipe has a spiral shape.

4. The ink drying apparatus according to claim 2 or 3, wherein at least one of the hot air supplying pipe and the exhausting pipe is opened at one side in the longitudinal direction and sealed at the other side in the longitudinal direction, and the one side in the longitudinal direction is communicated with the other side in the longitudinal direction.

5. The ink drying apparatus according to claim 1, further comprised at least one of heat retaining ducts in drying furnace for supplying hot air into the drying furnace, and at least one of exhausting ducts in drying furnace exhausting air in the drying furnace to the outside the drying furnace.

6. The ink drying apparatus according to claim 1, wherein the substrate drying duct is provided with outer ducts having a hot air blowout space for blowing hot air to the surface of the substrate and an exhaust space for sucking air in a surrounding area on which the hot air is blown out and inner ducts provided in the hot air blowout space and in the exhaust space respectively, an inside an inner duct provided in the hot air blowout space is opened to the hot air blowout space, and is communicated with the hot air supplying part, and an inside the inner duct provided in the exhaust space is opened to the exhaust space and is communicated with the exhausting part.

7. The ink drying apparatus according to claim 6, wherein the inner duct provided in the hot air blowout space has a plurality of supplying holes, an opening area of the supplying hole is decreased as separating from a part communicated with the hot air supplying part, and the inner duct provided in the exhaust space has a plurality of sucking holes, an opening area of the sucking hole is increased as separating from a part communicated with the exhausting part.

8. The ink drying apparatus according to claim 1, further comprising an infrared dryer for heating the substrate provided on an upstream side of the drying furnace in a substrate conveying direction.

9. The ink drying apparatus according to claim 1, further comprising a heat exchanger raising temperature of air flowing through the hot air supplying part with heat of air flowing to the exhausting part, air being at high temperature in the drying furnace.

* * * * *